US011505923B2

(12) United States Patent
Hiromatsu et al.

(10) Patent No.: US 11,505,923 B2
(45) Date of Patent: Nov. 22, 2022

(54) CONSTRUCTION MACHINE

(71) Applicant: HITACHI CONSTRUCTION MACHINERY CO., LTD., Tokyo (JP)

(72) Inventors: Kohei Hiromatsu, Ushiku (JP); Shiho Izumi, Hitachinaka (JP); Daito Sakai, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 436 days.

(21) Appl. No.: 16/644,309

(22) PCT Filed: Dec. 17, 2018

(86) PCT No.: PCT/JP2018/046416
§ 371 (c)(1),
(2) Date: Mar. 4, 2020

(87) PCT Pub. No.: WO2019/176208
PCT Pub. Date: Sep. 19, 2019

(65) Prior Publication Data

US 2021/0047805 A1 Feb. 18, 2021

(30) Foreign Application Priority Data

Mar. 15, 2018 (JP) ..... JP2018-048642

(51) Int. Cl.
*E02F 9/26* (2006.01)
*E02F 3/40* (2006.01)

(52) U.S. Cl.
CPC ..... *E02F 9/264* (2013.01); *E02F 3/40* (2013.01)

(58) Field of Classification Search
CPC ..... E02F 3/40; E02F 9/264
(Continued)

(56) References Cited

U.S. PATENT DOCUMENTS 8,942,895 B2 * 1/2015 Nomura ..... E02F 9/26 701/50
2007/0010925 A1 * 1/2007 Yokoyama ..... E02F 9/261 37/413

(Continued)

FOREIGN PATENT DOCUMENTS

CN 106888569 A * 6/2017 ..... E02F 3/963
EP 3767042 A1 * 1/2021 ..... E02F 3/40

(Continued)

OTHER PUBLICATIONS

International Preliminary Report on Patentability received in corresponding International Application No. PCT/JP2018/046416 dated Sep. 24, 2020.

(Continued)

*Primary Examiner* — Terrell H Matthews
(74) *Attorney, Agent, or Firm* — Mattingly & Malur, PC

(57) ABSTRACT

A construction machine that can display various work devices including a bucket on a display device without causing a sense of discomfort is provided. A display controller is configured to deform a first drawing figure to create a first post-deformation drawing figure such that a triangle having vertexes at a first coupling point, a second coupling point and a first monitor point in the first drawing figure becomes congruent with a triangle having vertexes at the first coupling point, the second coupling point and the first monitor point in a coordinate system on an image on a display device, and arrange the first post-deformation drawing figure on a screen of the display device such that positions of the first coupling point, the second coupling point and the first monitor point in the first post-deformation drawing figure are arranged correspondingly to positions of the first coupling point, the second coupling point and the first monitor point, respectively, in the coordinate system on the image.

7 Claims, 21 Drawing Sheets

(58) Field of Classification Search
USPC ..... 701/5
See application file for complete search history.

(56) References Cited

U.S. PATENT DOCUMENTS

| | | | | |
|---|---|---|---|---|
| 2013/0158787 | A1* | 6/2013 | Nomura | E02F 9/26 701/34.4 |
| 2015/0345114 | A1* | 12/2015 | Nomura | G01S 19/43 37/379 |
| 2016/0251835 | A1* | 9/2016 | Kitajima | E02F 3/3663 701/50 |
| 2017/0114526 | A1* | 4/2017 | Yasuda | E02F 9/264 |
| 2017/0167116 | A1 | 6/2017 | Fujii et al. | |

FOREIGN PATENT DOCUMENTS

| | | | | |
|---|---|---|---|---|
| JP | 2002-140731 | A | 5/2002 | |
| JP | 2010-253049 | A | 11/2010 | |
| JP | 6080983 | B | 2/2017 | |
| JP | 6080983 | B2 * | 2/2017 | E02F 3/963 |
| JP | 2019157569 | A * | 9/2019 | E02F 3/40 |
| WO | WO-2016056674 | A1 * | 4/2016 | E02F 3/963 |
| WO | 2016/076444 | A1 | 5/2016 | |
| WO | WO-2016076444 | A1 * | 5/2016 | E02F 3/3681 |
| WO | WO-2019207992 | A1 * | 10/2019 | E02F 3/308 |

OTHER PUBLICATIONS

International Search Report of PCT/JP2018/046416 dated Mar. 12, 2019.

* cited by examiner (a)

(b)

CONSTRUCTION MACHINE

TECHNICAL FIELD

The present invention relates to a construction machine such as a hydraulic excavator.

BACKGROUND ART

Typically, when construction machines such as hydraulic excavators perform construction such as excavation of grounds which are work targets, an operator operates an operation lever to thereby drive a work implement including a bucket. Construction by construction machines is performed on the basis of design drawings. In order to perform construction in accordance with a design drawing, it is necessary to accurately know the positional relationship between a construction target surface and a work device, but it is difficult for an operator to do so visually. In view of this, a technique of displaying the positional relationship between a construction target surface and a work device as seen from a side surface of a work implement has been proposed (e.g. Patent Document 1).

Patent Document 1 discloses a display system for a work machine having a work implement to which a bucket is attached, the display system including: a generating section that uses information on the shape and dimensions of the bucket to generate drawing information for drawing an image of the bucket in a side view; and a display section that displays the image of the bucket in the side view on the basis of the drawing information generated by the generating section, and an image illustrating a cross-section of a terrain. In the display system, the information on the shape and dimensions of the bucket includes: in a side view of the bucket, a distance between a blade tip of the bucket and a bucket pin used to attach the bucket to the work implement; an angle formed between a straight line linking the blade tip and the bucket pin and a straight line indicating the bottom surface of the bucket; a position of the blade tip; a position of the bucket pin; and at least one position of an external surface of the bucket, the one position being located between a portion that couples the bucket to the work implement and the blade tip (the paragraph [0006]).

PRIOR ART DOCUMENT

Patent Document

Patent Document 1: Japanese Patent No. 6080983

SUMMARY OF THE INVENTION

Problem to be Solved by the Invention

According to the work-machine display system described in Patent Document 1, a sense of discomfort felt by an operator can be reduced by making the shape of the bucket displayed on the display section correspond to the shape of a newly attached bucket in a case where the type of the bucket attached to the work implement is changed from one to another.

Meanwhile, the work devices of a construction machine include, other than a bucket used in excavation work, a hydraulic breaker used in fracturing work, a ripper and the like (a work device having a acute tip shape), a secondary breaker used in dismantling work, and a grapple and the like (a work device that has a movable section, and perform crushing and gripping). However, the work-machine display system described in Patent Document 1 is not suited for a construction machine used also for work other than excavation work since the work-machine display system does not support work devices other than the bucket.

The present invention has been made in view of the problem explained above, and an object thereof is to provide a construction machine that can display various work devices including a bucket on a display device without causing a sense of discomfort.

Means for Solving the Problem

In order to achieve the object explained above, the present invention provides a construction machine including: a work implement having a work device attached thereto pivotably via a first coupling pin and a second coupling pin; a display controller that creates a drawing figure representing a side surface of the work device on a basis of drawing information and dimensional information on the work device, and creates a target-surface figure representing a target surface on a basis of target-surface information; and a display device that displays the drawing figure and the target-surface figure. In the construction machine, the dimensional information on the work device includes positional information on a first coupling point positioned on a central axis of the first coupling pin, a second coupling point positioned on a central axis of the second coupling pin, and a first monitor point positioned on a contour of the work device, the contour being projected onto the operation plane, and the drawing information on the work device includes image information on a first drawing figure representing at least part of the work device, the part including the first coupling point, the second coupling point and the first monitor point. Further the display controller: calculates a posture of the work implement; calculates a coordinate value of each of the first coupling point, the second coupling point and the first monitor point in a coordinate system on an image on the display device on a basis of the postural information on the work implement and the dimensional information on the work device; deforms the first drawing figure to create a first post-deformation drawing figure such that a triangle having vertexes at the first coupling point, the second coupling point and the first monitor point in the first drawing figure becomes congruent with a triangle having vertexes at the first coupling point, the second coupling point and the first monitor point in the coordinate system on the image on the display device; and arranges the first post-deformation drawing figure on a screen of the display device such that positions of the first coupling point, the second coupling point and the first monitor point in the first post-deformation drawing figure are arranged correspondingly to positions of the first coupling point, the second coupling point and the first monitor point, respectively, in the coordinate system on the image on the display device.

According to the thus-configured present invention, the first post-deformation drawing figure is created such that the triangle having vertexes at the first coupling point, the second coupling point and the first monitor point in the first drawing figure representing at least part of the work device becomes congruent with the triangle having vertexes at the first coupling point, the second coupling point and the first monitor point in the coordinate system on the image on the display device, and the first post-deformation drawing figure is arranged on the screen of the display device such that the positions of the first coupling point, the second coupling point and the first monitor point in the first post-deformation drawing figure are arranged correspondingly to the positions of the first coupling point, the second coupling point and the first monitor point, respectively, in the coordinate system on the image on the display device. Thereby, it becomes possible to display various work devices on the display device without causing a sense of discomfort.

Advantages of the Invention

A construction machine according to the present invention can display various work devices including a bucket on a display device without causing a sense of discomfort.

MODES FOR CARRYING OUT THE INVENTION

Figure 1:
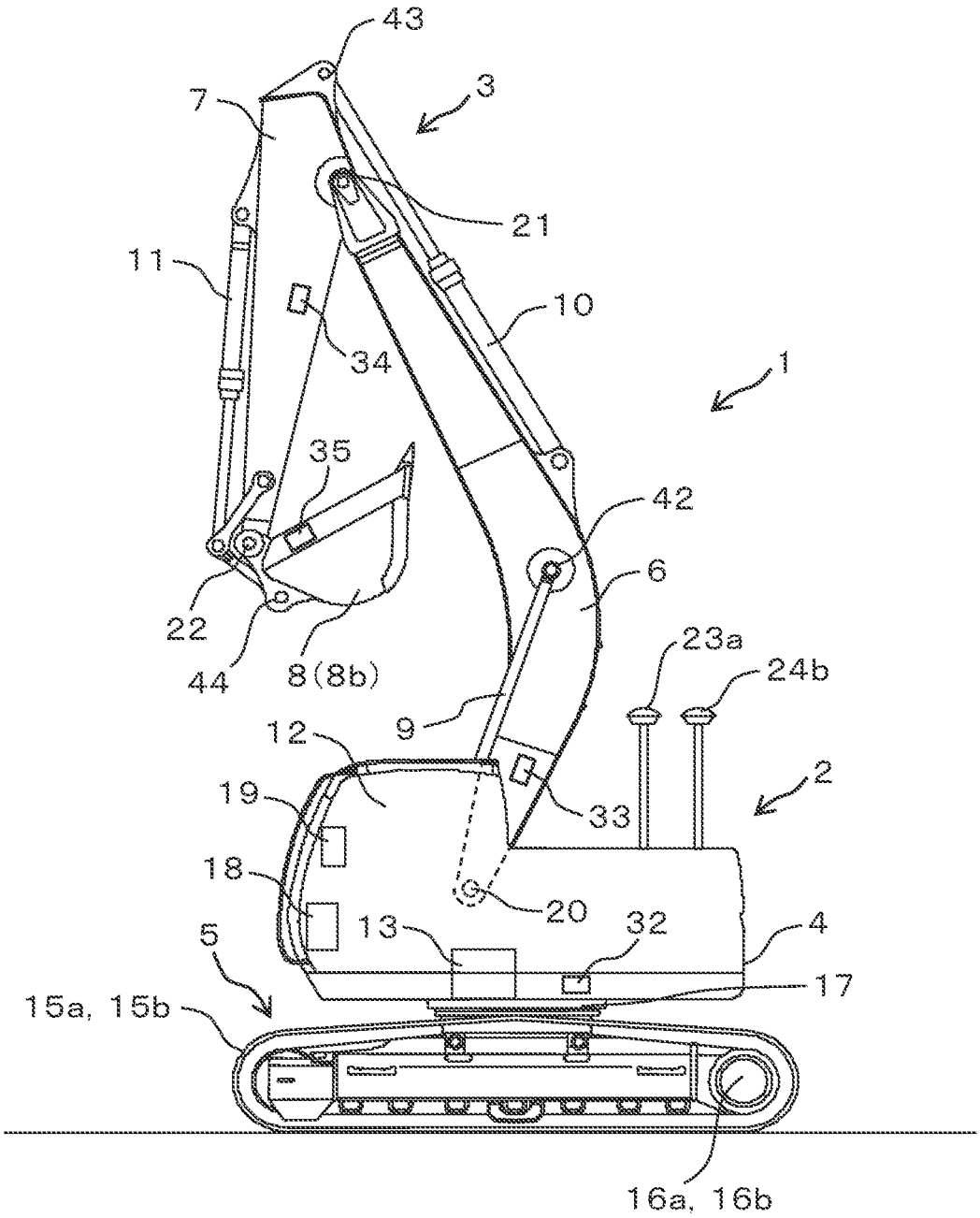
FIG. 1 is a side view illustrating a hydraulic excavator as one example of a construction machine according to an embodiment of the present invention.

Hereinafter, as an example of a construction machine according to embodiments of the present invention, a hydraulic excavator is explained with reference to the drawings. Note that in the drawings, members equivalent to each other are given the same characters, and overlapping explanations are omitted as appropriate.

FIG. 1 is a side view illustrating a hydraulic excavator according to an embodiment of the present invention.

In FIG. 1, the hydraulic excavator 1 includes a lower track structure 5, an upper swing structure 4 and a work implement 3. The upper swing structure 4 and the lower track structure 5 constitute a vehicle main body 2.

The lower track structure 5 has crawlers 15*a* and 15*b* on both sides. By travel motors 16*a* and 16*b* being rotated by means of hydraulic pressures, the crawlers 15*a* and 15*b* are driven individually, and the hydraulic excavator 1 travels.

The upper swing structure 4 is connected pivotably to the lower track structure 5 via a slewing ring 17, and is driven by being rotated by a swing motor 13 by means of a hydraulic pressure. The upper swing structure 4 has a cab 12, the swing motor 13, an engine and a hydraulic pump which are not illustrated, and a hydraulic controller 14 (illustrated in FIG. 2) constituted by hydraulic control valves and the like. A machine-body operation device 18 and a display device 19 that are mentioned below are installed in the cab 12. A machine-body inclination-angle sensor 32 that senses an inclination of the machine body is attached to the upper swing structure 4. Antennas 23*a* and 23*b* are attached to an upper portion of the upper swing structure 4. The antennas 23*a* and 23*b* are used for receiving signals from an artificial satellite which is not illustrated, and sensing the current position of the hydraulic excavator 1 on the earth.

The work implement 3 has a boom 6, an arm 7, a work device 8 (a bucket 8*b* in the example illustrated in FIG. 1), a first cylinder 9, a second cylinder 10 and a third cylinder 11. The boom 6 is attached pivotably to the upper swing structure 4 via a first link pin 20. The arm 7 is attached pivotably to a tip portion of the boom 6 via a second link pin 21. The work device 8 is attached pivotably to a tip portion of the arm 7 via a third link pin (first coupling pin) 22. The first cylinder 9 is attached pivotably to the boom 6 via a first cylinder pin 42, the second cylinder 10 is attached pivotably to the arm 7 via a second cylinder pin 43, and the third cylinder 11 is attached pivotably to the work device 8 via a third cylinder pin (second coupling pin) 44. The first cylinder 9, the second cylinder 10 and the third cylinder 11 extend and retract by means of hydraulic pressures to drive the boom 6, the arm 7 and the work device 8, respectively. First to third rotation-angle sensors 33 to 35 that sense the postures of the boom 6, the arm 7 and the work device 8 are attached to the boom 6, the arm 7 and the work device 8, respectively.

Figure 2:
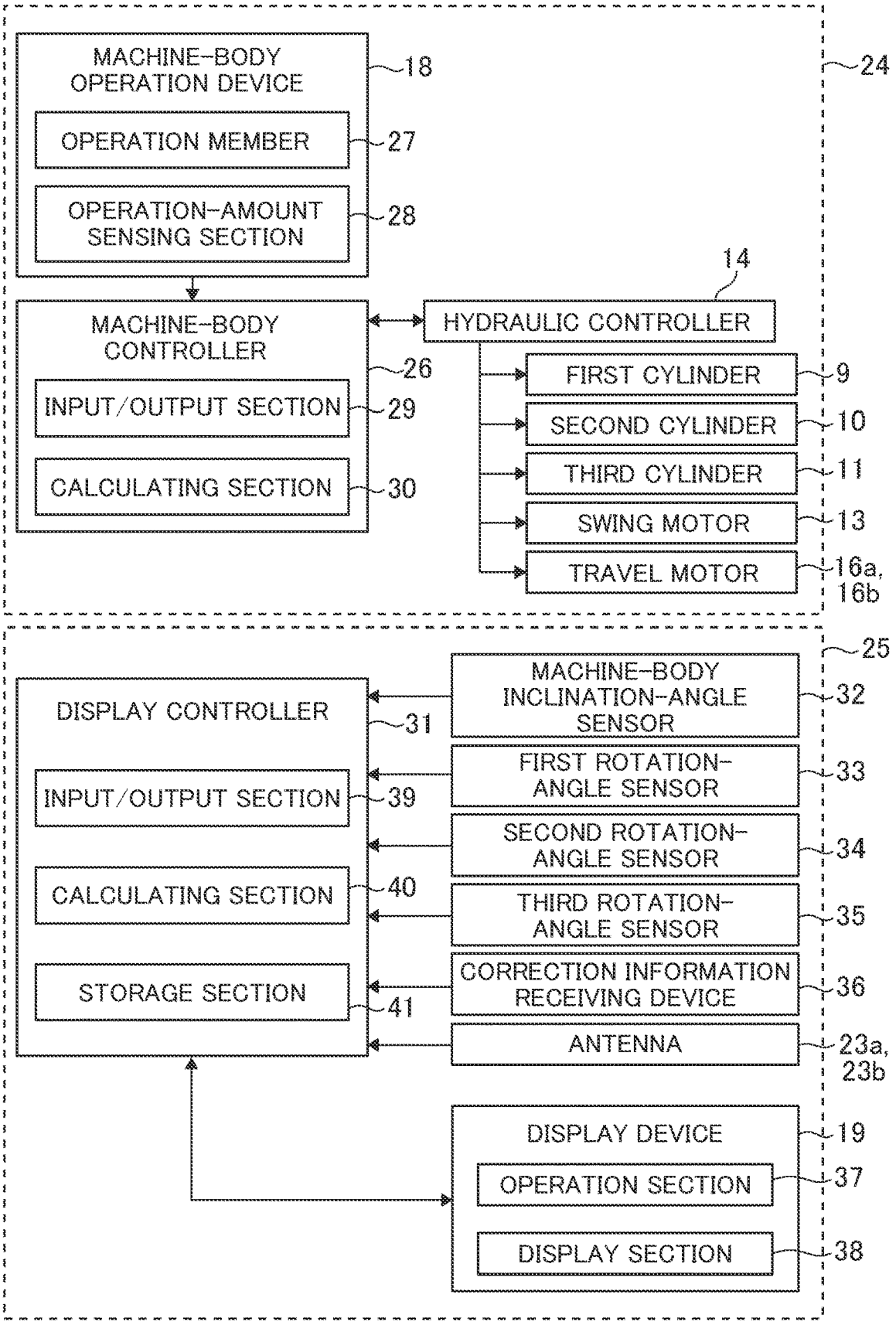
FIG. 2 is a block diagram illustrating the configurations of a machine-body control system and a display system mounted on the hydraulic excavator illustrated in FIG. 1.

FIG. 2 is a block diagram illustrating the configurations of a machine-body control system 24 and a display system 25 mounted on the hydraulic excavator 1.

As illustrated in FIG. 2, the machine-body control system 24 has the first cylinder 9, the second cylinder 10, the third cylinder 11, the swing motor 13, the travel motors 16*a* and 16*b*, the hydraulic controller 14, the machine-body operation device 18 and a machine-body controller 26.

The hydraulic controller 14 distributes and supplies a hydraulic operating fluid delivered from the hydraulic pump to a plurality of hydraulic actuators including the first cylinder 9, the second cylinder 10, the third cylinder 11, the swing motor 13 and the travel motors 16*a* and 16*b*, and drives them.

The machine-body operation device 18 has an operation member 27 and an operation-amount sensing section 28.

The operation member 27 is a member (e.g. a work lever) for an operator in the cab 12, for instruction of driving of the first cylinder 9, the second cylinder 10, the third cylinder 11, the swing motor 13 and the travel motors 16*a* and 16*b*. The operation-amount sensing section 28 senses an operation amount of the operation member 27, and sends a sensing signal to the machine-body controller 26.

The machine-body controller 26 has an input/output section 29 such as an A/D converting section, a D/A converting section and a digital input/output device, and a calculating section 30 such as a CPU.

The input/output section 29 of the machine-body controller 26 sends, to the calculating section 30, signals input from the machine-body operation device 18 and the hydraulic controller 14, and sends a result of calculation performed by the calculating section 30 to the hydraulic controller 14.

The calculating section 30 of the machine-body controller 26 calculates a command value to the hydraulic controller 14 on the basis of an operation amount indicated by a signal sent from the operation-amount sensing section 28 and a state quantity of the hydraulic controller 14.

The display system 25 has the machine-body inclination-angle sensor 32, the first to third rotation-angle sensors 33 to 35, a correction information receiving section 36, the antennas 23*a* and 23*b*, the display device 19 and a display controller 31.

The machine-body inclination-angle sensor 32 is an inertial measurement unit (IMU), for example, and typically is a sensor formed by combining an angular velocity sensor and an acceleration sensor. The machine-body inclination-angle sensor 32 is attached to the upper swing structure 4, and is used for sensing the angle formed between a front-rear direction of the upper swing structure 4 and the vertical (gravity) direction, when it is defined that the horizontal direction on the operation plane of the work implement 3 is the front-rear direction and the direction perpendicular to the operation plane of the work implement 3 is the left-right direction.

The first to third rotation-angle sensors 33 to 35 are IMUs, for example, which are attached to the boom 6, the arm 7, and the work device 8, respectively, sense the angle around the first link pin 20 formed between the boom 6 and the vertical (gravity) direction, the angle around the second link pin 21 formed between the arm 7 and the vertical (gravity) direction, and the angle around the third link pin 22 formed between the work device 8 and the vertical (gravity) direction, and output the angle of the boom 6 relative to the upper swing structure 4, the angle of the arm 7 relative to the boom 6, and the angle of the work device 8 relative to the arm 7, respectively.

The correction information receiving section 36 is a wireless communication section, for example, and receives correction information that is transmitted wirelessly from a correction information transmitting section not illustrated and located outside the hydraulic excavator 1, and that is for use in calculation of a global position.

The display device 19 has an operation section 37, and a display section 38.

The operation section 37 of the display device 19 is a switch, for example. The operation section 37 is operated by an operator to switch display information, and add or change settings of coordinate information on a target surface, and drawing information like the type and dimensions of the work device 8 stored in a storage section 41 of the display controller 31 mentioned below.

The display section 38 of the display device 19 is a liquid crystal display and a speaker, for example, and displays drawing information calculated by a calculating section 40 of the display controller 31 for an operator to check work contents.

The display device 19 may be one like a touch panel formed by integrating the operation section 37 and the display section 38, for example.

The display controller 31 has an input/output section 39 such as an A/D converting section, a D/A converting section or a digital input/output device, the calculating section 40 such as a CPU and a storage section 41 such as a ROM or a RAM.

The input/output section 39 of the display controller 31 sends, to the calculating section 40, angle signals input from the machine-body inclination-angle sensor 32 and the first to third rotation-angle sensors 33 to 35, sensing signals of the antennas 23*a* and 23*b*, and operation signals input from the operation section 37 of the display device 19, and sends a result of calculation performed by the calculating section 40 to the display section 38 of the display device 19.

The input/output section 39 of the display controller 31 further has an external connection terminal (e.g. a USB (Universal Serial Bus) terminal) that can be connected with an external storage device (e.g. a USB memory) 90, and can store, in the storage section 41, target-surface information and work-device drawing information that are stored in the external storage device 90 and edited in another electronic device.

In this manner, in the present embodiment, the display controller 31 has the storage section 41 that stores drawing information and dimensional information on the work device 8, and the input/output section 39 that can be connected with the external storage device 90, and the display controller 31 can store, in the storage section 41, drawing information and dimensional information on the work device 8 stored in the external storage device 90, via the input/output section 39.

Figure 3:
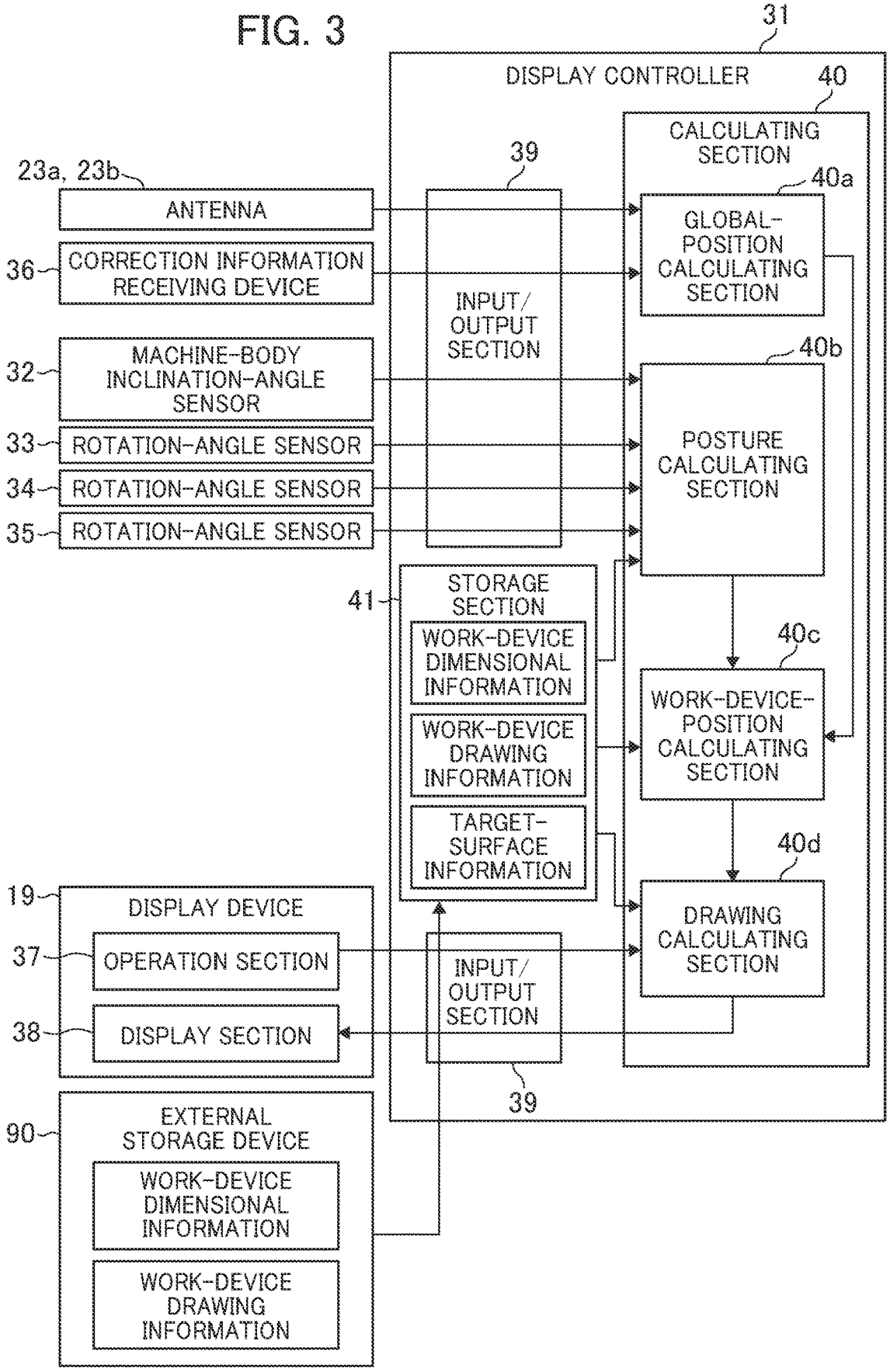
FIG. 3 is a block diagram illustrating a configuration of a calculating section of the display controller illustrated in FIG. 2.

FIG. 3 is a block diagram illustrating the configuration of the calculating section 40 of the display controller 31.

As illustrated in FIG. 3, the calculating section 40 of the display controller 31 has a global-position calculating section 40*a*, a posture calculating section 40*b*, a work-device-position calculating section 40*c* and a drawing calculating section 40*d*.

The storage section 41 of the display controller 31 stores a machine-body dimensional parameter, an angle conversion parameter, target-surface information and work-device drawing information. The machine-body dimensional parameter includes, for example, dimensions of the boom 6, the arm 7 and the work device 8, and relative positions between the antennas 23*a* and 23*b*, and the first link pin 20 (three-dimensional vectors, and the like). The target-surface information includes coordinates of a cross-section on at least one plane which is a work target of the hydraulic excavator 1.

The work-device drawing information includes image information on a drawing figure of the work device 8, and coordinate values on an image associated with the drawing figure.

On the basis of sensing signals of the antennas 23*a* and 23*b* from an artificial satellite and correction information from the correction information receiving section 36, the global-position calculating section 40*a* uses an RTK-GNSS (RealTime Kinematic-Global Navigation Satellite System; GNSS stands for the Global Navigation Satellite System) to calculate the current positions of the antenna 23*a* and 23*b* in the global (earth) coordinate system.

On the basis of a sensing signal of the machine-body inclination-angle sensor 32, angle signals of the first to third rotation-angle sensors 33 to 35 and the angle conversion parameter in the storage section 41, the posture calculating section 40*b* calculates a left-right inclination angle θ0*x* of the upper swing structure 4, a front-rear inclination angle θ0*y* of the upper swing structure 4, an angle θ1 around the first link pin 20 of the boom 6 relative to the machine body, an angle θ2 around the second link pin 21 of the arm 7 relative to the boom 6, and an angle θ3 around the third link pin 22 of the work device 8 relative to the arm 7.

On the basis of the angles θ1 to θ3 which are a result of calculation performed by the posture calculating section 40*b*, and the machine-body dimensional parameter in the storage section 41, the work-device-position calculating section 40*c* defines a work-implement operation plane (X-Z plane) as a two-dimensional coordinate system. The work-implement operation plane (X-Z plane) has its origin at the center of the first link pin 20, passes through the origin, and the centers of the second and third link pins 21 and 22, and is formed by a Z axis and an X axis. The positive direction of the Z axis is the upward direction relative to the direction of gravity. The X axis is perpendicular to the Z axis, and the positive direction of the X axis is the direction of extension of the work implement 3. The work-device-position calculating section 40*c* calculates the coordinate, on the work-implement operation plane (X-Z plane), of a first monitor point MP1 which is located in the work device 8 and is a point of interest in terms of work, the coordinate of the central axis of the third link pin 22, and the coordinate of the central axis of the third cylinder pin 44.

On the basis of the angles θ0*x* and θ0*y*, which are a result of calculation performed by the posture calculating section 40*b*, a result of calculation performed by the global-position calculating section 40*a*, and the machine-body dimensional parameter in the storage section 41, the work-device-position calculating section 40*c* further calculates the first monitor point MP1, the coordinates of the central axis of the third link pin 22, and the coordinates of the central axis of the third cylinder pin 44 in the global (earth) coordinate system.

On the basis of information on the type and dimensions of the work device 8 that are set through the operation section 37 of the display device 19, a result of calculation performed by the work-device-position calculating section 40*c*, and the target-surface information and work-device drawing information in the storage section 41, the drawing calculating section 40*d* creates a guidance image, and outputs the guidance image to the display section 38.

First Embodiment

Figure 4:
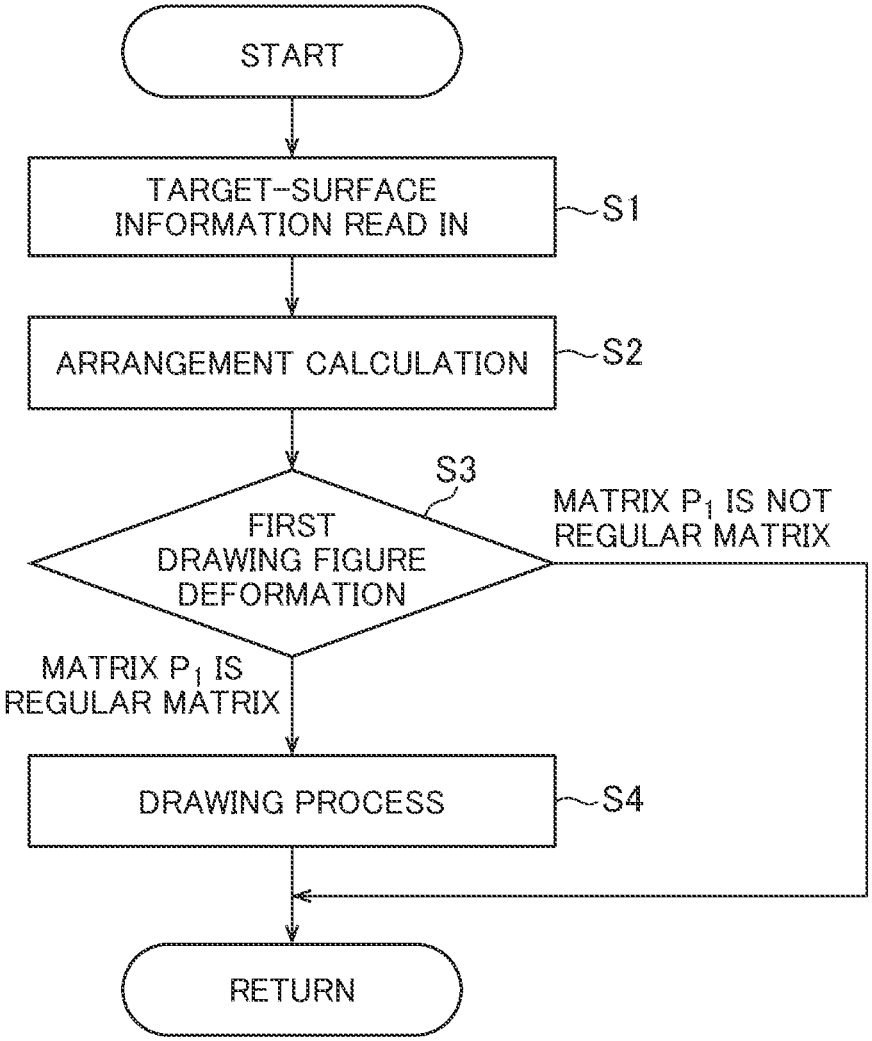
FIG. 4 is a flowchart illustrating one example of a drawing-calculation process performed by the display controller according to a first embodiment of the present invention.
Figure 5:
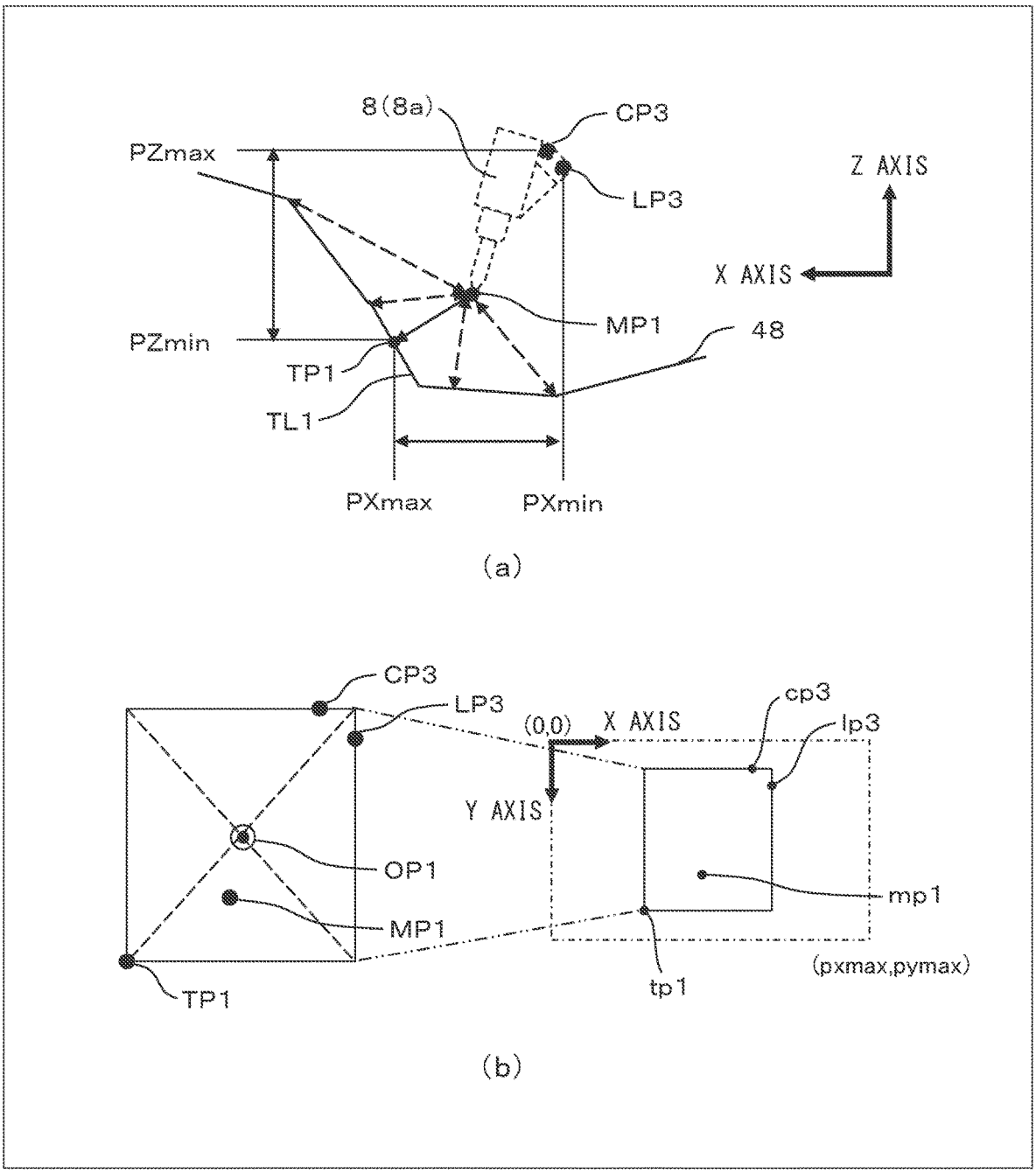
FIG. 5 is a figure illustrating an outline of a method of arranging a drawing figure of a hydraulic breaker and a target-surface figure in a coordinate system on an image according to the first embodiment of the present invention.
Figure 6:
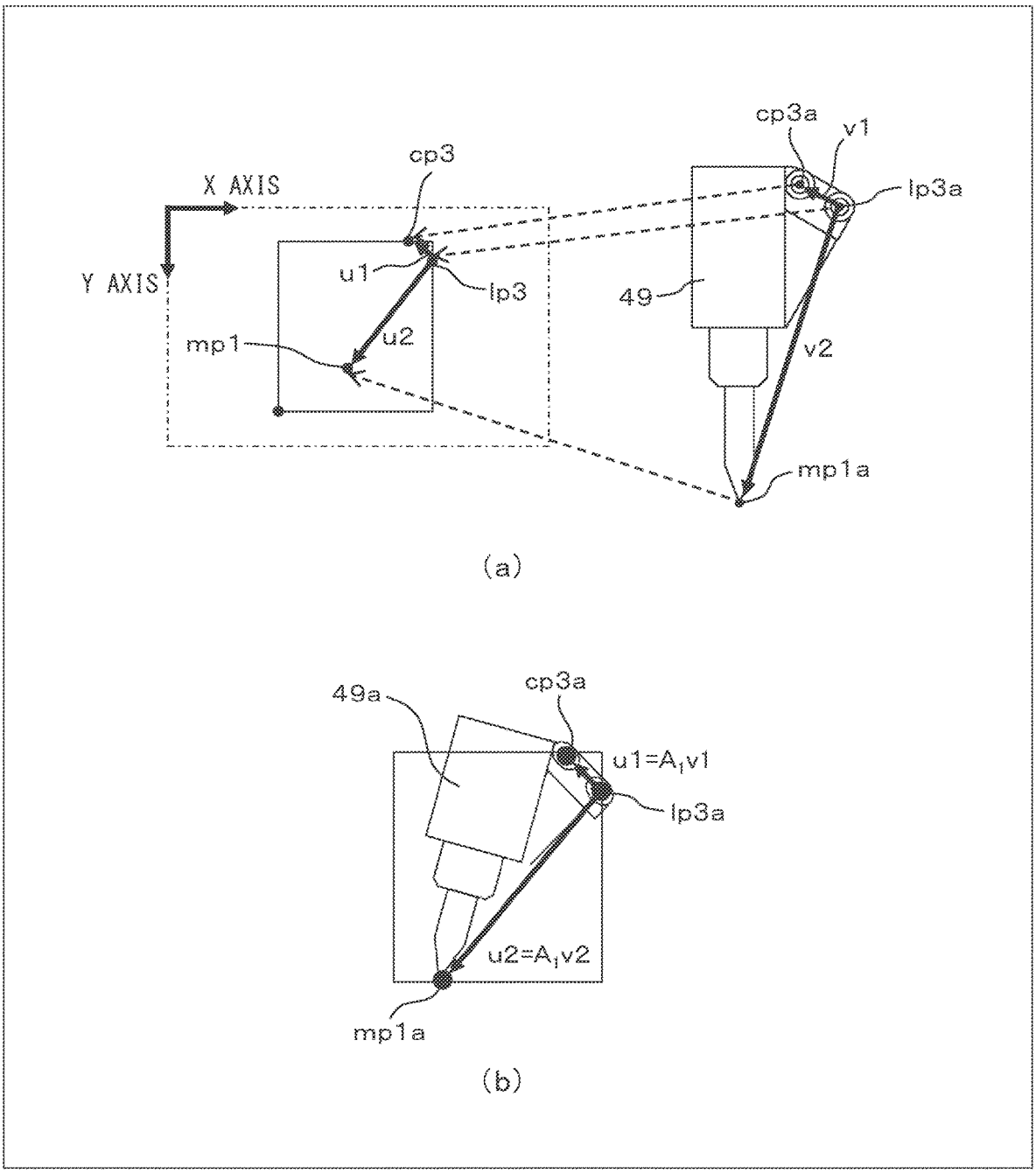
FIG. 6 is a figure illustrating one example of a method of deforming a first drawing figure representing the hydraulic breaker according to the first embodiment of the present invention.

The hydraulic excavator 1 according to a first embodiment of the present invention is explained by using FIG. 4 to FIG. 6. The hydraulic excavator 1 according to the present embodiment includes a hydraulic breaker as the work device 8.

FIG. 4 is a flowchart illustrating one example of a drawing-calculation process performed by the display controller 31 according to the present embodiment. In a case where the work device 8 attached to the hydraulic excavator 1 is a work device having one monitor point (e.g. a hydraulic breaker 8*a*), the display controller 31 creates a side surface image (guidance image) illustrating a positional relationship between a target surface and the work device 8 in accordance with the flowchart illustrated in FIG. 4.

At Step S1, target-surface information is read in from the storage section 41, and a target-surface FIG. 48 (illustrated in FIG. 5(*a*)) is created. The target-surface information is polygon data constituted by line segments and a plane arranged in the global coordinate system, for example. The target-surface FIG. 48 is a line of intersection between the work-implement operation plane (X-Z plane) and the plane constituting the polygon data, and is defined in a local coordinate system on the work-implement operation plane (X-Z plane).

The work-implement operation plane (X-Z plane) is calculated from the positions of the antennas 23*a* and 23*b* obtained at the global-position calculating section 40*a*, and the first to third link pins 20 to 22 relative to the antenna 23*a* and 23*b* included in the machine-body dimensional parameter in the storage section 41, and the target-surface FIG. 48 is updated successively when the hydraulic excavator 1 moves or rotates relative to the target surface indicated by the target-surface information as a result of travel operation, swing operation and the like.

At Step S2, the target-surface FIG. 48 obtained from Step S1, and the work-device position obtained from the work-device-position calculating section 40*c* are used, and arranged in a coordinate system on an image.

Since the coordinate system on the image has the maximum values [px max, py max] in the longitudinal direction and the lateral direction that are defined by the size of a screen of the display section 38, a scale Ksc and an offset OP1 are determined for arranging the entire work device 8 and at least one line segment constituting the target-surface FIG. 48 such that the entire work device 8 and the at least one line segment are included in the screen.

FIG. 5 illustrates an outline of a method of arranging a drawing figure of the hydraulic breaker 8*a* and the target-surface FIG. 48 in the coordinate system on the image on the basis of the positions of the first monitor point MP1, the third link pin 22, the third cylinder pin 44 and the target-surface FIG. 48 on the work-implement operation plane (X-Z plane).

As illustrated in FIG. 5(*a*), a point positioned at the tip of the hydraulic breaker 8*a* (a point positioned on the contour of hydraulic breaker 8*a* projected onto the work-implement operation plane (X-Z plane)) is defined as the first monitor point MP1, a point at which the central axis of the third link pin 22 crosses the working-implement operation plane (X-Z plane) (hereinafter, referred to as a "third-link-pin central point" as appropriate) is defined as a point LP3, and a point at which the central axis of the third cylinder pin 44 crosses the working-implement operation plane (X-Z plane) (hereinafter, referred to as a "third-cylinder-pin central point" as appropriate) is defined as a point CP3.

In order to extract at least one line segment for drawing from the target-surface FIG. 48, the distance between the point MP1 and each of all line segments constituting the target-surface FIG. 48 is calculated, the line segment closest to the target-surface FIG. 48 is defined as a nearest line segment TL1, and a first nearest target-surface point TP1 included in the nearest line segment is acquired.

Next, the maximum value and minimum value, PXmax and PXmin, and the maximum value and minimum value, PZmax and PZmin, on the work-implement operation plane (X-Z plane) along the X axis and the Z axis, respectively, are acquired from the four points which are the point MP1, the point LP3, the point CP3 and the point TP1.

As illustrated in FIG. 5(*b*), the offset OP1 is calculated according to the following formula such that the center of the acquired maximum values and minimum values of the four points is located at the origin.

[Equation 1]

$$OP1 = \frac{1}{2} \times \begin{bmatrix} PXmax - PXmin \\ PZmax - PZmin \end{bmatrix} \tag{1}$$

The scale Kscl is obtained from the minimum value of the quotients of the maximum values [pxmax, pymax] of the size of the screen divided by the differences between the maximum values and the minimum values of the four points on the work-implement operation plane (X-Z plane). The scale Kscl is calculated according to the following formula.

[Equation 2]

$$Ksc1 = \min\left(\frac{PXmax - PXmin}{pxmax}, \frac{PZmax - Pzmin}{pymax}\right) \times \alpha sc1 \tag{2}$$

In the formula, min is an operator for selecting the minimum value from arguments, and αsc1 is a positive real number, and is a coefficient for displaying the four points on the work-implement operation plane (X-Z plane) inside the screen end.

The coordinate system of a screen typically has its origin at the upper left of the screen, and has an x axis whose positive direction is the right direction, and a y axis whose positive direction is the downward direction. In a case where a side view of the work device 8 as seen from the left is to be created, a point Pn on the work-implement operation plane (X-Z plane) (local coordinate system) is converted into a point pn in the coordinate system on the image according to the following formula.

[Equation 3]

$$pn = \begin{bmatrix} pxmax/2 \\ pymax/2 \end{bmatrix} - Ksc1 \times (Pn - OP1) \tag{3}$$

The point MP1, the point LP3, the point CP3 and the point TP1 of the work-device position and the target-surface FIG. 48 on the work-implement operation plane (X-Z plane) are converted into a point mp1, a point lp3, a point cp3 and a point tp1, respectively, in the coordinate system on the image according to Formula (3).

At Step S3, the three points which are the point mp1, the point lp3 and the point cp3 indicating the work-device position in the coordinate system on the image calculated at Step S2 are used to perform a process of deforming the drawing figure included in the work-device drawing information which is associated with that the work-device-type information set through the operation section 37 of the display device 19 is about the hydraulic breaker 8*a*.

The work-device drawing information which is associated with that the work-device-type information is about the hydraulic breaker 8*a* includes image information on a first drawing FIG. 49 (illustrated in FIG. 6(*a*)) including the first monitor point MP1, the third-link-pin central point (first coupling point) LP3 and the third-cylinder-pin central point (second coupling point) CP3 of the hydraulic breaker 8*a*, and the coordinate values of the point mp1*a*, the point lp3*a* and the point cp3*a* indicating the positions of the first monitor point MP1, the third-link-pin central point LP3 and the third-cylinder-pin central point CP3, respectively, in a coordinate system on the first drawing FIG. 49.

FIG. 6 illustrates one example of a method of deforming the first drawing FIG. 49 representing the hydraulic breaker 8*a* on the basis of work-device dimensional information on the actually attached hydraulic breaker 8*a* and work-device drawing information indicating the hydraulic breaker 8*a*.

Linear mapping is used as a technique for a process of deforming the first drawing FIG. 49. Linear mapping deforms an image by using an image deformation matrix A to move pixel information included in coordinates pi=[pxi, pyi] on an image to other coordinates qi=[qxi, qyi]. Linear mapping is represented by the following formula.

[Equation 4]

$$\begin{bmatrix} qxi \\ qyi \end{bmatrix} = A \begin{bmatrix} pxi \\ pyi \end{bmatrix} \tag{4}$$

The image deformation matrix A used for linear mapping to deform the first drawing FIG. 49 can be obtained from the work-device dimensional information on the hydraulic breaker 8*a*, and information on coordinates on an image plane.

A vector u1 originating at the point lp3 and terminating at the point cp3 is defined as [u1*x*, u1*y*], a vector u2 originating at the point lp3 and terminating at the point mp1 is defined as [u2*x*, u2*y*], a vector v1 originating at the point lp3*a* and terminating at the point cp3*a* is defined as [v1*x*, v1*y*], and a vector v2 originating at the point lp3*a* and terminating at the point mp1*a* is defined as [v2*x*, v2*y*]. Matrixes P1 and Q1 created from the vectors v1 and v2 and the vectors u1 and u2, respectively, are represented by the following formulae.

[Equation 5]

$$P_1 = \begin{bmatrix} v1x & v2x \\ v1y & v2y \end{bmatrix} \quad (5)$$

[Equation 6]

$$Q_1 = \begin{bmatrix} u1x & u2x \\ u1y & u2y \end{bmatrix} \quad (6)$$

Since the vectors v1 and u1 are vectors corresponding to each other on the hydraulic breaker 8*a* actually attached to the hydraulic excavator 1 as the work device 8 and on the hydraulic breaker 8*a* on the image, respectively, and the vectors v2 and u2 are vectors corresponding to each other on the hydraulic breaker 8*a* actually attached to the hydraulic excavator 1 as the work device 8 and on the hydraulic breaker 8*a* on the image, respectively, a method of converting the matrix P1 into the matrix Q1 by using the image deformation matrix A1 according to Formulae (4) to (6) is represented by the following formula.

[Equation 7]

$$Q_1 = A_1 P_1 \quad (7)$$

Therefore, the image deformation matrix A1 is represented by the following formula by using the matrix Q1 and an inverse matrix $P1^{-1}$ of the matrix P1.

[Equation 8]

$$A_1 = Q_1 P_1^{-1} \quad (8)$$

It should be noted, however, that the case where there is the inverse matrix $P1^{-1}$ of the matrix P1 is the case where the matrix P1 is a regular matrix, and in a case where the determinant of the matrix P1 is 0 as an exemplary case where the matrix P1 is decided as not a regular matrix, the process does not proceed to Step S4, but the calculation of the drawing calculating section 40*d* ends.

In a case where the matrix P is a regular matrix, and there is the inverse matrix $P1^{-1}$ of the matrix P1, the image deformation matrix A obtained according to Formula (8) is used to deform the first drawing FIG. 49 of the hydraulic breaker 8*a*, and create a first post-deformation drawing FIG. 49*a* (illustrated in FIG. 6(*b*)), and the process proceeds to Step S4.

At Step S4, a drawing image is created on the screen of the display section 38 on the basis of the first post-deformation drawing FIG. 49*a* of the hydraulic breaker 8*a* obtained at Step S3, and the arrangement of the work device 8 and the target-surface FIG. 48 on a drawing screen obtained from Step S2.

The first post-deformation drawing FIG. 49*a* of the hydraulic breaker 8*a* is arranged in the drawing image with the three points which are the point mp1*a*, the point lp3*a* and the point cp3*a* (illustrated in FIG. 6(*b*)) included in the image being arranged correspondingly to the corresponding three points which are the point mp1, the point lp3 and the point cp3 (illustrated in FIG. 6(*a*)) of the work-device position included in the drawing image.

For the image of the target-surface FIG. 48, a straight line passing through the point tp1 and having the same inclination as the nearest line segment TL1 is drawn to extend from the point tp1 toward both sides of the point tp1.

In a case where the coordinates of the position of an end point of the line segment TL1 obtained by conversion into the coordinate system on the image according to Formula (3) are located before the maximum values [px max, py max] or located beyond the minimum values [0, 0], the line segment is drawn to the end point.

On the other hand, in a case where the coordinates of the position of an end point of the line segment TL1 obtained by conversion into the coordinate system on the image according to Formula (3) are located beyond the maximum values [px max, py max], a temporary end point of a new line segment is created at an intersection between the line segment and an outer circumferential section of the screen, and the line segment is drawn to the temporary end point.

Similarly, Formula (3) is applied sequentially to line segments that are included in the target-surface FIG. 48 in an order starting from the ones adjacent to the nearest line segment TL1, and a range of the target-surface FIG. 48 in the coordinate system on the image that fits in the screen is drawn.

In this manner, in the present embodiment, the construction machine 1 includes: the work implement 3 having the work device 8 attached pivotably via the first coupling pin 22 and the second coupling pin 44; the display controller 31 that creates a drawing figure representing a side surface of the work device 8 on the basis of drawing information and dimensional information on the work device 8, and creates a target-surface figure representing a target surface on the basis of target-surface information; and the display device 19 that displays the drawing figure and the target-surface figure. In the construction machine 1, the dimensional information on the work device 8 includes: positional information on the first coupling point LP3 positioned on the central axis of the first coupling pin 22; positional information on the second coupling point CP3 positioned on the central axis of the second coupling pin 44; and positional information on the first monitor point MP1 positioned on the contour of the work device 8 projected onto an operation plane of the work implement 3. Further, the drawing information on the work device 8 includes image information on the first drawing FIG. 49 representing at least part of the work device 8 including the first coupling point LP3, the second coupling point CP3 and the first monitor point MP1. Furthermore, the display controller 31 includes: the posture calculating section 40*b* that calculates the posture of the work implement 3; the work-device-position calculating section 40*c* that calculates the coordinate values of each of the first coupling point LP3, the second coupling point CP3 and the first monitor point MP1 in a coordinate system on an image on the display device 19 on the basis of the postural information on the work implement 3 and the dimensional information on the work device 8; and the drawing calculating section 40*d* that deforms the first drawing FIG. 49 to create the first post-deformation drawing FIG. 49*a* such that a triangle having vertexes at the first coupling point LP3, the second coupling point CP3 and the first monitor point MP1 in the first drawing FIG. 49 becomes congruent with a triangle having vertexes at the first coupling point LP3, the second coupling point CP3 and the first monitor point MP1 in the coordinate system on the image on the display device 19, the drawing calculating section 40*d* arranging the first post-deformation drawing FIG. 49*a* on a screen of the display device 19 such that the positions of the first coupling point LP3, the second coupling point CP3 and the first monitor point MP1 in the first post-deformation drawing FIG. 49*a* are arranged correspondingly to the positions of the first coupling point LP3, the second coupling point CP3 and the first monitor point MP1, respectively in the coordinate system on the image on the display device 19.

According to the thus-configured hydraulic excavator 1 according to the present embodiment, the first post-deformation drawing FIG. 49*a* is created such that the triangle having vertexes at the first coupling point lp3*a*, the second coupling point cp3*a* and the first monitor point mp1*a* in the first drawing FIG. 49 representing the hydraulic breaker 8*a* becomes congruent with the triangle having vertexes at the first coupling point lp3, the second coupling point cp3 and the first monitor point mp1 in the coordinate system on the image on the display device 19, and the first post-deformation drawing FIG. 49*a* is arranged on the screen of the display device 19 such that the first coupling point lp3*a*, the second coupling point cp3*a* and the first monitor point mp1*a* in the first post-deformation drawing FIG. 49*a* are arranged correspondingly to the first coupling point lp3, the second coupling point cp3 and the first monitor point mp1, respectively, in the coordinate system on the image on the display device 19. Thereby, it becomes possible to display hydraulic breakers 8*a* with different dimensions and/or shapes on the display device 19 without causing a sense of discomfort.

Note that although the hydraulic breaker 8*a* is illustrated as an example of the work device 8 in the present embodiment, the work device 8 is not limited as long as the work device 8 includes a first monitor point MP1, a third link pin 22 and a third cylinder pin 44, and the hydraulic breaker 8*a* may be replaced with a single-claw ripper and the like.

Second Embodiment

The hydraulic excavator 1 according to a second embodiment of the present invention is explained by using FIG. 7 to FIG. 10. The hydraulic excavator 1 according to the present embodiment includes a bucket as the work device 8.

Figure 8:
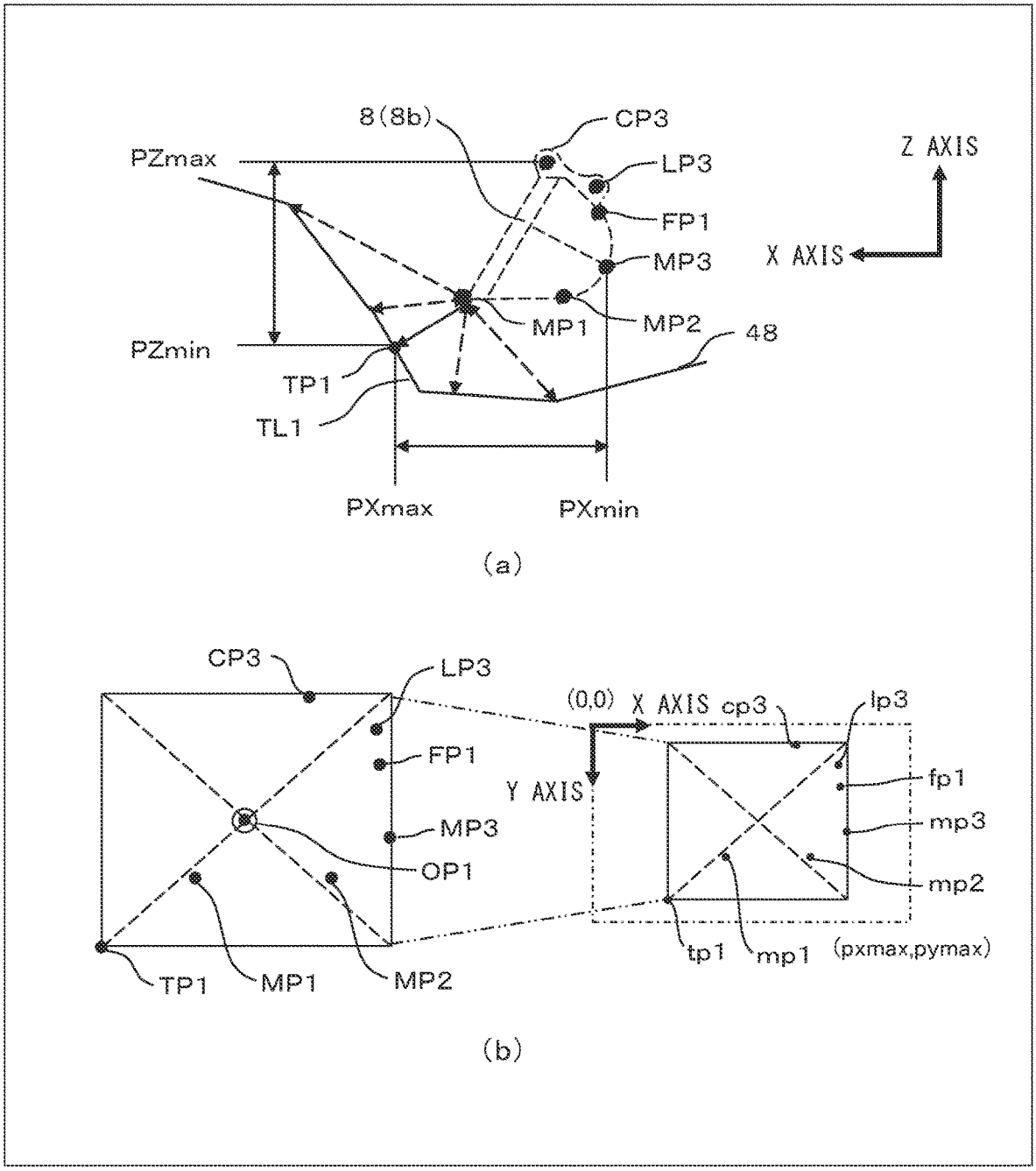
FIG. 8 is a figure illustrating an outline of a method of arranging a drawing figure of a bucket and a target-surface figure in a coordinate system on an image according to the second embodiment of the present invention.

Differences from the first embodiment are as follows: as illustrated in FIG. 8(*a*), there is at least one monitor point other than the first monitor point MP1 inside a bucket 8*b* as the work device 8; there is one feature point in terms of the structure of the work device 8; and there are at least two drawing figures to be used in drawing the work device 8.

In addition to the calculation in the first embodiment, the work-device-position calculating section 40*c* (illustrated in FIG. 3) further calculates the positions of second and third monitor points MP2 and MP3 which are in the work device 8 and are points of interest in terms of a work other than the first monitor point MP1, and a feature point in terms of the structure of the work device 8 (hereinafter, referred to as a "first feature point") FP1, the positions being calculated in terms of the work-implement operation plane (X-Z plane) and in terms of the global coordinate system.

In a similar manner to the first embodiment, on the basis of information on the type and dimensions of the work device that are set through the operation section 37 of the display device 19, a result of calculation performed by the work-device-position calculating section 40*c*, and the target-surface information and work-device drawing information in the storage section 41, the drawing calculating section 40*d* (illustrated in FIG. 3) creates a guidance image, and outputs the guidance image to the display section 38.

Figure 7:
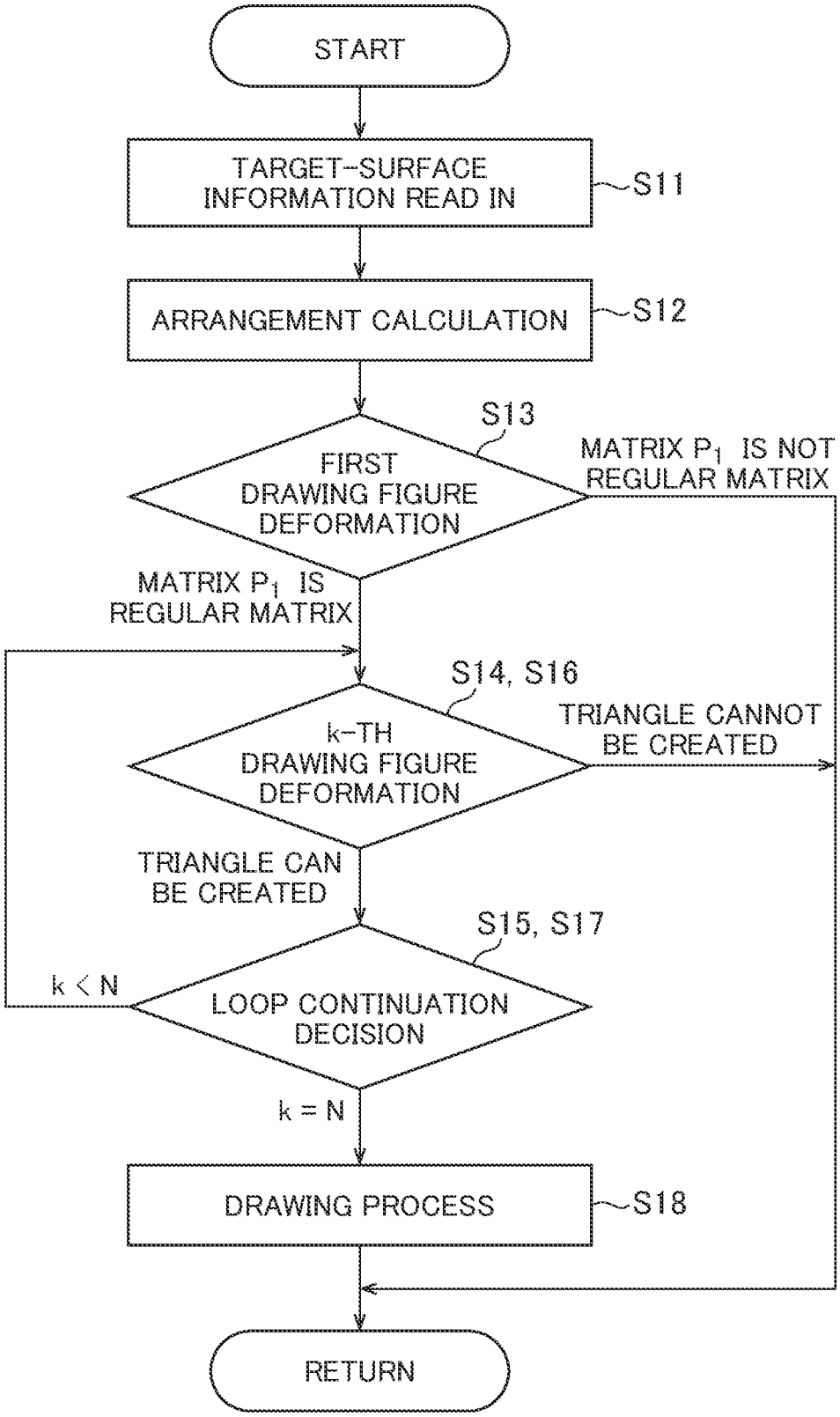
FIG. 7 is a flowchart illustrating one example of a drawing-calculation process performed by a display controller according to a second embodiment of the present invention.

FIG. 7 is a flowchart illustrating one example of a drawing-calculation process performed by the display controller 31 according to the present embodiment. In a case where the work device 8 attached to the hydraulic excavator 1 is a work device having at least two monitor points (e.g. the bucket 8*b*), the display controller 31 creates a side surface image (guidance image) illustrating a positional relationship between a target surface and the work device 8 in accordance with the flowchart illustrated in FIG. 7.

At Step S11, in a similar manner to Step S1 in the first embodiment, the target-surface information is read in from the storage section 41.

At Step S12, the target-surface FIG. 48 obtained from Step S11, and the work-device position obtained from the work-device-position calculating section 40*c* are used, and arranged in a coordinate system on an image.

Since the coordinate system on the image has the maximum values [px max, py max] in the longitudinal direction and the lateral direction that are defined by the size of a screen of the display section 38, the scale Kscl and the offset OP1 are determined for arranging the entire work device 8 and at least one line segment constituting the target-surface FIG. 48 such that the entire work device 8 and the at least one line segment are included in the screen.

FIG. 8 illustrates the outline of a method of arranging a drawing figure of the bucket 8*b* and the target-surface FIG. 48 in the coordinate system on the image on the basis of the positions of the first monitor point MP1, the second and third monitor points MP2 and MP3, the first feature point FP1, the third-link-pin central point LP3, the third-cylinder-pin central point CP3 and the target-surface FIG. 48 on the work-implement operation plane (X-Z plane).

As illustrated in FIG. 8(*a*), a point positioned at the tip of the bucket 8*b* (a point positioned on the contour of the bucket 8*b* projected onto the work-implement operation plane (X-Z plane)) is defined as the first monitor point MP1, and points positioned on the rear surface of the bucket 8*b* (points positioned on the contour of the bucket 8*b* projected onto the work-implement operation plane (X-Z plane)) are defined as the second and third monitor points MP2 and MP3. In addition, an end point of a joint between a member for attaching the bucket 8*b* to the arm 7 and to the third cylinder 11 and a member to serve as a rear plate of the bucket 8*b* (a point positioned on the contour of the bucket 8*b* projected onto the work-implement operation plane (X-Z plane)) is defined as the first feature point FP1.

In order to extract at least one line segment for drawing from the target-surface FIG. 48, the distance between the point MP1 and each of all line segments constituting the target-surface FIG. 48 is calculated, the line segment closest to the target-surface FIG. 48 is defined as the nearest line segment TL1, and the first nearest target-surface point TP1 included in the nearest line segment is acquired.

Next, the maximum value and minimum value, PX max and PX min, and the maximum value and minimum value, PZ max and PZ min, on the work-implement operation plane (X-Z plane) along the X axis and the Z axis, respectively, are acquired from the seven points which are the point MP1, the point MP2, the point MP3, the point FP1, the point LP3, the point CP3 and the point TP1.

As illustrated in FIG. 8(*b*), the offset OP1 is calculated according to Formula (1) such that the center of the acquired maximum values and minimum values of the seven points is located at the origin.

The scale Kscl is obtained from the minimum value of the quotients of the maximum values [px max, py max] of the size of the screen divided by the differences between the maximum values and the minimum values of the seven points on the work-implement operation plane (X-Z plane). The scale Kscl is calculated according to Formula (2).

The point MP1, the point MP2, the point MP3, the point FP1, the point LP3, the point CP3 and the point TP1 of the work-device position and the target-surface FIG. 48 on the work-implement operation plane (X-Z plane) (local coordinate system) are converted into the point mp1, the point mpg, the point mp3, the point fp1, the point lp3, the point cp3 and the point tp1, respectively, in the coordinate system on the image according to Formula (3).

At Step S13, the three points which are the point mp1, the point lp3 and the point cp3 indicating the work-device position in the coordinate system on the image calculated at Step S12 are used to perform a process of deforming a first drawing FIG. 53 included in the work-device drawing information which is associated with that the work-device-type information set through the operation section 37 of the display device 19 is about the bucket 8*b*.

The work-device drawing information which is associated with that the work-device-type information is about the bucket 8*b* includes image information on the first drawing FIG. 53 including the first monitor point MP1, the third-link-pin central point LP3 and the third-cylinder-pin central point CP3 of the bucket 8*b*, and the coordinate values of the point mp1*a*, the point lp3*a* and the point cp3*a* indicating the positions of the first monitor point MP1, the third-link-pin central point LP3 and the third-cylinder-pin central point CP3, respectively, in a coordinate system on the first drawing FIG. 53.

Figure 9:
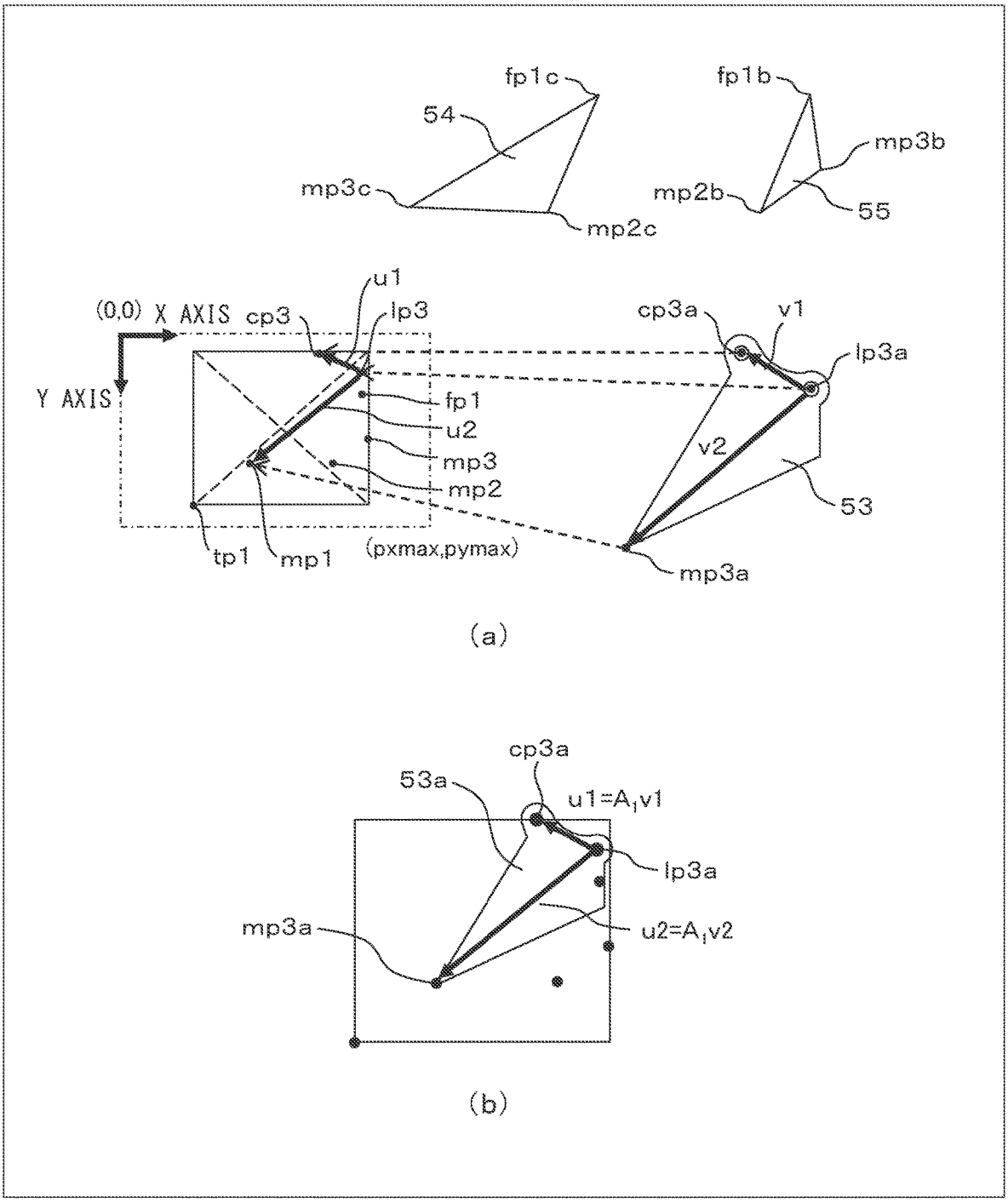
FIG. 9 is a figure illustrating one example of a method of deforming a first drawing figure representing part of the bucket according to the second embodiment of the present invention.

FIG. 9 illustrates one example of a method of deforming the first drawing FIG. 53 of the bucket 8*b* on the basis of work-device dimensional information on the actually attached bucket 8*b* and work-device drawing information indicating the bucket 8*b*.

In a similar manner to the first embodiment, linear mapping is used as a technique for a process of deforming the first drawing FIG. 53. Linear mapping is represented by Formula (4).

The image deformation matrix A1 used for linear mapping to convert the first drawing FIG. 53 can be obtained from the work-device dimensional information on the bucket 8*b*, and information on positions at coordinates of the first drawing FIG. 53.

A vector u1 originating at the point lp3 and terminating at the point cp3 is defined as [u1*x*, u1*y*], a vector u2 originating at the point lp3 and terminating at the point mp1 is defined as [u2*x*, u2*y*], a vector v1 originating at the point lp3*a* and terminating at the point cp3*a* is defined as [v1*x*, v1*y*], and a vector v2 originating at the point lp3*a* and terminating at the point mp1*a* is defined as [v2*x*, v2*y*]. According to these definitions, the image deformation matrix A1 is represented by Formulae (5) to (8).

It should be noted, however, that the case where there is the inverse matrix $P1^{-1}$ of the matrix P1 is the case where the matrix P1 is a regular matrix, and in a case where the determinant of the matrix P1 is 0 as an exemplary case where the matrix P1 is decided as not a regular matrix, the process does not proceed to Step S14, but the calculation of the drawing calculating section 40*d* ends.

Figure 10:
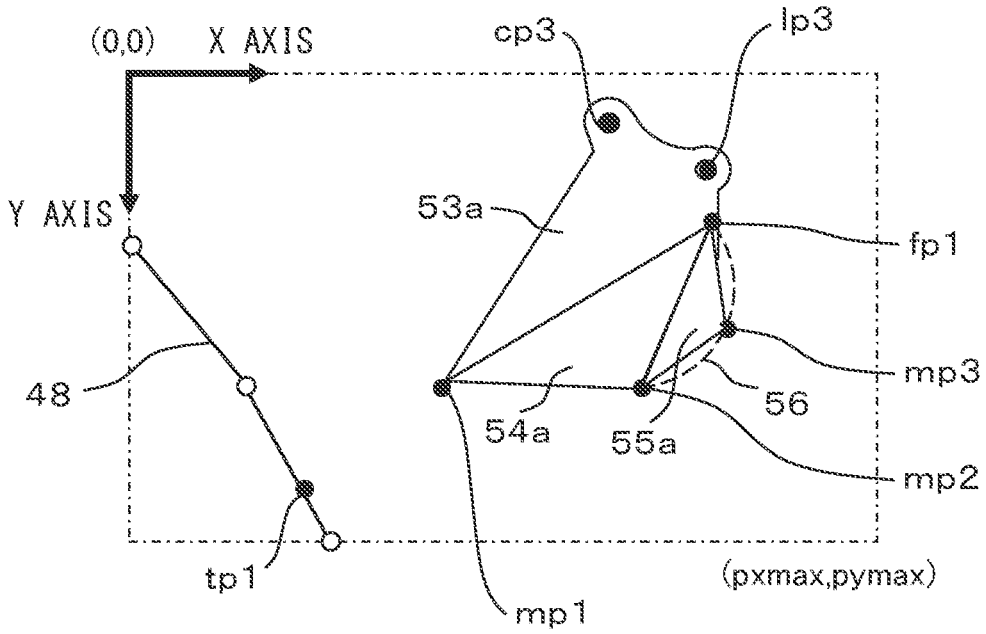
FIG. 10 is a figure illustrating a state where first to third post-deformation drawing figures representing the bucket are arranged in a drawing image according to the second embodiment of the present invention.

In a case where the matrix P1 is a regular matrix, and there is the inverse matrix $P1^{-1}$ of the matrix P1, the image deformation matrix A1 obtained according to Formula (8) is used to deform the first drawing FIG. 53 of the bucket 8*b*, and create a first post-deformation drawing FIG. 53*a* (illustrated in FIG. 9(*b*) or FIG. 10), and the process proceeds to Step S14.

At Step S14, loop processing is performed N times which is the same as the number of monitor points other than the first monitor point MP1. Since the number of monitor points other than the first monitor point MP1 is two in the present embodiment, N=2.

The point mp(k), the point mp(k+1) and the point fp1 indicating the work-device position in the coordinate system on the image that are calculated at Step S12, that is, the three points which are mp1, the point mpg and the point fp1 since the number of times of loop k is 1, are used to perform a process of deforming a second drawing FIG. 54 included in the work-device drawing information which is associated with that the work-device-type information set through the operation section 37 of the display device 19 is about the bucket 8*b*.

The work-device drawing information which is associated with that the work-device-type information is about the bucket 8*b* includes image information on the second drawing FIG. 54 which is a triangle having vertexes at the first monitor point MP1, the second monitor point MP2 and the first feature point FP1 of the bucket 8*b*, and the coordinate values of the point mp1*b*, the point mp2*b* and the point fp1*b* indicating the positions of the first monitor point MP1, the second monitor point MP2 and the first feature point FP1, respectively, in a coordinate system on the second drawing FIG. 54.

It should be noted, however, that the case where there is a triangle is the case where all of the point mp1*b*, the point mp2*b* and the point fp1*b* which are three points constituting the triangle are not collinear, and in a case where the three points are collinear, the process does not proceed to Step S15, but the calculation of the drawing calculating section 40*d* ends.

When the three points are not collinear, as a process of deforming the second drawing FIG. 54, the second drawing FIG. 54 is deformed such that a triangle linking the point mp1, the point mp2 and the point fp1 becomes congruent with a triangle which is the second drawing FIG. 54 to create a second post-deformation drawing FIG. 54*a* (illustrated in FIG. 10), and the process proceeds to Step S15.

At Step S15, a loop continuation decision is made. At this time, since the number of times of loop k=1, and k<N=2, the value of k is increased, and the process returns to the loop processing.

At Step S16, the point mp(k), the point mp(k+1) and the point fp1 indicating the work-device position in the coordinate system on the image that are calculated at Step S12, that is, the three points which are the point mp2, the point mp3 and the point fp1 since the number of times of loop k is 2, are used to perform a process of deforming a third drawing FIG. 55 included in the work-device drawing information which is associated with that the work-device-type information set through the operation section 37 of the display device 19 is about the bucket 8*b*.

The work-device drawing information which is associated with that the work-device-type information is about the bucket 8*b* includes image information on the third drawing FIG. 55 which is a triangle having vertexes at the second monitor point MP2, the third monitor point MP3 and the first feature point FP1 of the bucket 8*b*, and the coordinate values of the point mp2*c*, the point mp3*c* and the point fp1*c* indicating the positions of the second monitor point MP2, the third monitor point MP3 and the first feature point FP1, respectively, in a coordinate system on the third drawing FIG. 55.

It should be noted, however, that the case where there is a triangle is the case where all of the point mp2*c*, the point mp3*c* and the point fp1*c* which are three points constituting the triangle are not collinear, and in a case where the three points are collinear, the process does not proceed to Step S15, but the calculation of the drawing calculating section 40*d* ends. When the three points are not collinear, as a process of deforming the third drawing FIG. 55, the third drawing FIG. 55 is deformed such that a triangle linking the point mpg, the point mp3 and the point fp1 becomes congruent with a triangle which is the third drawing FIG. 55 to create a third post-deformation drawing FIG. 55*a* (illustrated in FIG. 10), and the process proceeds to Step S17.

At Step S17, a continuation decision about the loop continuing from Step S14 is made. At this time, since the number of times of loop k=2=N, the loop processing ends, and the process proceeds to Step S18.

At Step S18, a drawing image is created on the screen of the display section 38 on the basis of the first to third post-deformation drawing FIGS. 53*a* to 55*a* of the bucket 8*b* obtained at Steps S13, S14 and S16, and the arrangement of the work device 8 and the target-surface FIG. 48 on a drawing screen obtained from Step S12.

FIG. 10 illustrates a state where the first to third post-deformation drawing FIGS. 53*a* to 55*a* representing the bucket 8*b* are arranged in the drawing image.

The first post-deformation drawing FIG. 53*a* of the bucket 8*b* is arranged in the drawing image with the three points which are the point mp1*a*, the point lp3*a* and the point cp3*a* included in the image being arranged correspondingly to the corresponding three points which are the point mp1, the point lp3 and the point cp3 of the work-device position included in the drawing image.

The second post-deformation drawing FIG. 54*a* of the bucket 8*b* is arranged in the drawing image with the three points which are the point mp1*b*, the point mp2*b* and the point fp1*b* included in the image being arranged correspondingly to the corresponding three points which are the point mp1, the point mpg and the point fp1 of the work-device position included in the drawing image.

The third post-deformation drawing FIG. 55*a* of the bucket 8*b* is arranged in the drawing image with the three points which are the point mp2*c*, the point mp3*c* and the point fp1*c* included in the image being arranged correspondingly to the corresponding three points which are the point mpg, the point mp3 and the point fp1 of the work-device position included in the drawing image.

A range of the image of the target-surface FIG. 48 that fits in the screen is drawn, in a similar manner to the first embodiment.

In this manner, in the present embodiment, the work device 8 is a bucket, the first monitor point MP1 is positioned at the tip of the bucket 8, the dimensional information on the work device 8 further includes positional information on the first monitor point MP1, the second monitor point MP2 at a position on the rear surface of the bucket 8, and the first feature point FP1 at another position on the rear surface of the bucket 8. Further, the drawing information on the work device 8 further includes image information on the second drawing FIG. 54 representing part of the work device 8 including the first monitor point MP1, the second monitor point MP2 and the first feature point FP1. Furthermore, the work-device-position calculating section 40*c* calculates the coordinate values of each of the second monitor point MP2 and the first feature point FP1 on the basis of the dimensional information on the work device 8, and the drawing calculating section 40*d* deforms the second drawing FIG. 54 to create the second post-deformation drawing FIG. 54*a* such that a triangle having vertexes at the first monitor point MP1, the second monitor point MP2 and the first feature point FP1 in the second drawing FIG. 54 becomes congruent with a triangle having vertexes at the first monitor point MP1, the second monitor point MP2 and the first feature point FP1 in the coordinate system on the image on the display device 19, and arranges the second post-deformation drawing FIG. 54*a* on the screen of the display device 19 such that the positions of the first monitor point MP1, the second monitor point MP2 and the first feature point FP1 in the second drawing FIG. 54 are arranged correspondingly to the positions of the first monitor point MP1, the second monitor point MP2 and the first feature point FP1, respectively, in the coordinate system on the image on the display device 19.

In addition, the dimensional information on the work device 8 further includes positional information on the second monitor point MP2, the first feature point FP1 and the third monitor point MP3 at a position on the rear surface of the bucket 8, the drawing information on the work device 8 further includes image information on the third drawing FIG. 55 representing part of the work device 8 including the second monitor point MP2, the third monitor point MP3 and the first feature point FP1, the work-device-position calculating section 40*c* calculates the coordinate values of the third monitor point MP3 on the basis of the dimensional information on the work device 8, and the drawing calculating section 40*d* deforms the third drawing FIG. 55 to create the third post-deformation drawing FIG. 55*a* such that a triangle having vertexes at the second monitor point MP2, the third monitor point MP3 and the first feature point FP1 in the third drawing FIG. 55 becomes congruent with a triangle having vertexes at the second monitor point MP2, the third monitor point MP3 and the first feature point FP1 in the coordinate system on the image on the display device 19, and arranges the third post-deformation drawing FIG. 55*a* on the screen of the display device 19 such that the positions of the second monitor point MP2, the third monitor point MP3 and the first feature point FP1 in the third post-deformation drawing FIG. 55*a* are arranged correspondingly to the positions of the second monitor point MP2, the third monitor point MP3 and the first feature point FP1, respectively, in the coordinate system on the image on the display device 19.

According to the thus-configured hydraulic excavator 1 according to the present embodiment, it becomes possible to display buckets 8*b* with different dimensions and/or shapes on the display device 19 without causing a sense of discomfort.

Note that although the bucket 8*b* is illustrated as an example of the work device 8 in the present embodiment, the work device 8 is not limited as long as the work device 8 includes a plurality of monitor points, a third link pin 22 and a third cylinder pin 44, and the bucket 8*b* may be replaced with a magnet and the like.

In addition, although the number of monitor points is three in the case illustrated as an example in the present embodiment, the number of monitor points may be any number as long as it is two or larger, and the number is not limited.

In addition, although deformation of the second and third drawing FIGS. 54 and 55 is executed such that the triangles become congruent in the present embodiment, linear mapping may be used in a similar manner to the first drawing FIG. 53.

In addition, although an image of the bucket 8*b* to be drawn is angular at monitor points since deformation of the second and third drawing FIGS. 54 and 55 is executed such that the triangles become congruent in the present embodiment, it is also possible at Step S18 to represent the image with smooth lines like the bottom surface 56 (a section indicated by broken lines) of the bucket 8*b* illustrated in FIG. 10 by using a spline curve passing through points including any monitor point and the first feature point FP1, and filling regions between the spline curve and the second and third drawing FIGS. 54 and 55 with paint.

Third Example

The hydraulic excavator 1 according to a third embodiment of the present invention is explained by using FIG. 11 to FIG. 14. The hydraulic excavator 1 according to the present embodiment includes a secondary crusher as the work device 8.

Figure 12:
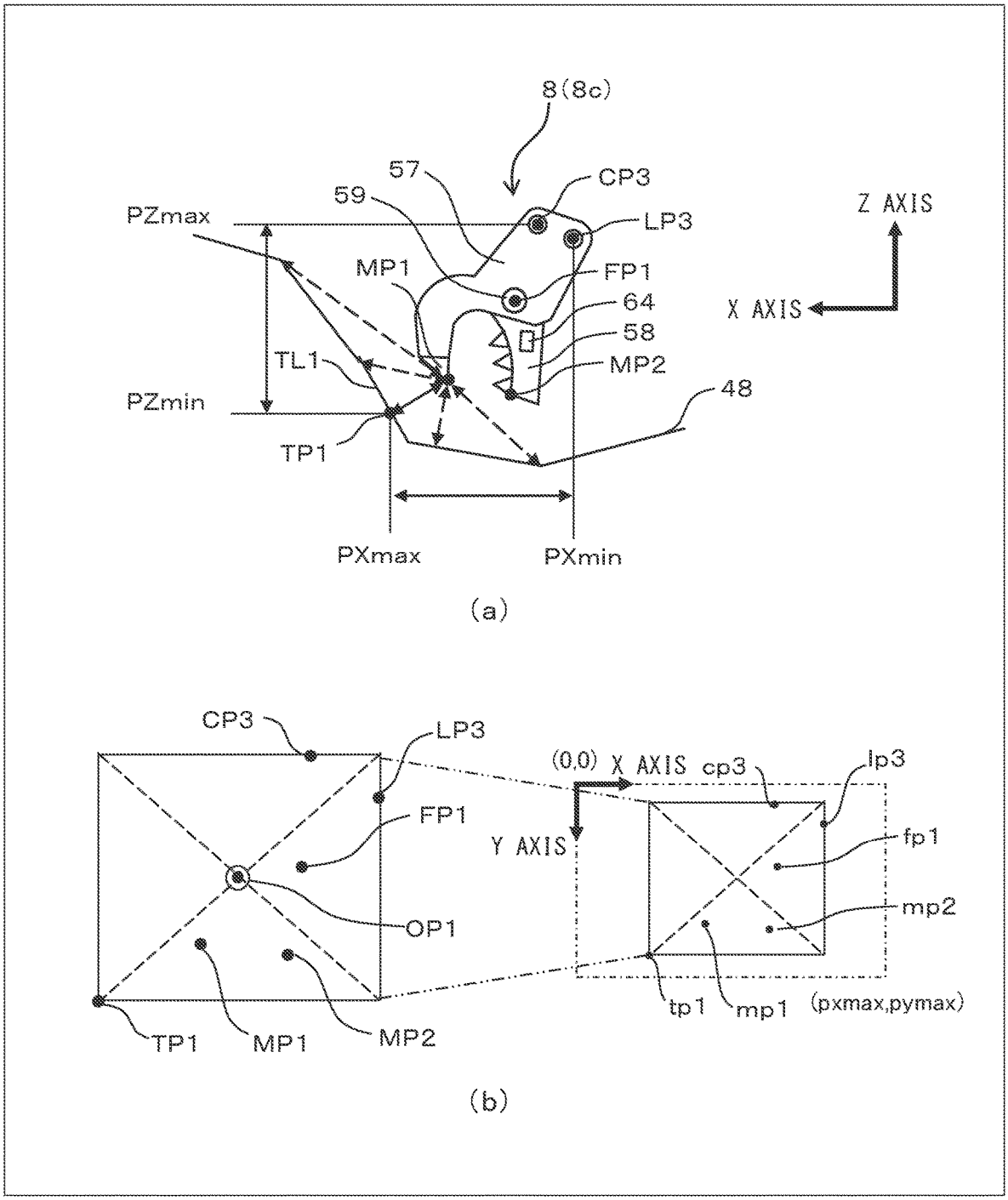
FIG. 12 is a figure illustrating an outline of a method of arranging a drawing figure of a secondary crusher and a target-surface figure in a coordinate system on an image according to the third embodiment of the present invention.

Differences from the first embodiment are as follows: as illustrated in FIG. 12(*a*), a secondary crusher 8*c* as the work device 8 has a work-device frame (base portion) 57 and a work-device arm (first driven portion) 58, the work-device frame 57 includes therein the first monitor point MP1, and the work-device arm 58 includes therein the second monitor point MP2; the second monitor point MP2 exhibits a rotational movement about the first feature point FP1 in terms of the structure included in the work-device frame 57; and two drawing figures of the work device 8 are included.

The work-device arm 58 is pivotably connected to the work-device frame 57 via a fourth link pin (third coupling pin) 59, and is driven by a fourth cylinder 63. That is, the first feature point FP1 is a point on the central axis of the fourth link pin 59. As a first posture sensor to sense the posture of the work-device arm 58, a fourth rotation-angle sensor 64 is attached to the work-device arm 58. The fourth rotation-angle sensor 64 is an IMU, for example, which is attached to the work-device arm 58, senses the angle around the fourth link pin 59 formed between the work-device arm 58 and the vertical (gravity) direction, and outputs the angle of the work-device arm 58 relative to the work-device frame 57.

In addition to the calculation in the first embodiment, further on the basis of an angle signal of the fourth rotation-angle sensor 64, and the angle conversion parameter in the storage section 41, the posture calculating section 40*b* (illustrated in FIG. 3) calculates an angle θ4 around the fourth link pin 59 of the work-device arm 58 relative to the work-device frame 57.

In addition to the calculation in the first embodiment, on the basis of the angle θ4 calculated at the posture calculating section 40*b*, the work-device-position calculating section 40*c* (illustrated in FIG. 3) further calculates the positions of the second monitor point MP2 included in the work-device arm 58, and the first feature point FP1 in terms of the structure included in the work-device frame 57, the positions being calculated in terms of the work-implement operation plane (X-Z plane) and in terms of the global coordinate system.

In a similar manner to the first embodiment, on the basis of information on the type and dimensions of the work device that are set through the operation section 37 of the display device 19, a result of calculation performed by the work-device-position calculating section 40*c*, and the target-surface information and work-device drawing information in the storage section 41, the drawing calculating section 40*d* (illustrated in FIG. 3) creates a guidance image.

Figure 11:
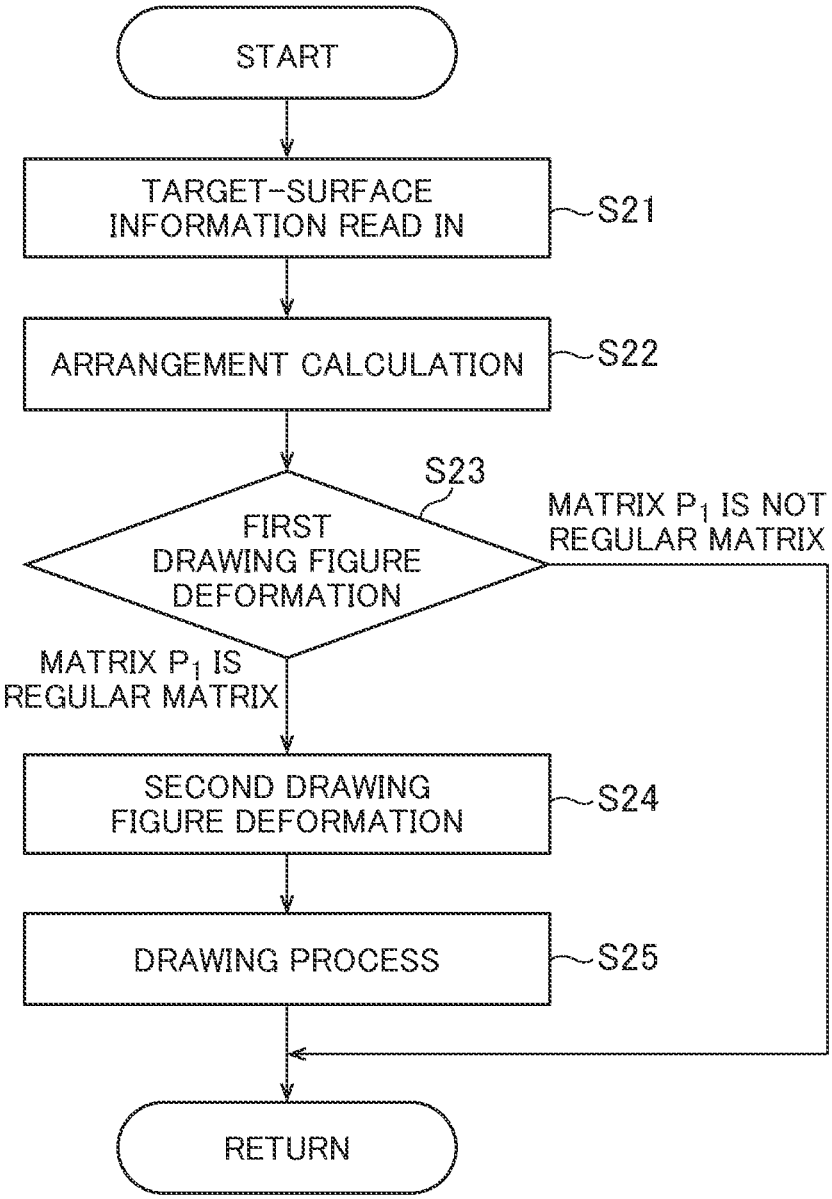
FIG. 11 is a flowchart illustrating one example of a drawing-calculation process performed by a display controller according to a third embodiment of the present invention.

FIG. 11 is a flowchart illustrating one example of a drawing-calculation process performed by the display controller 31 according to the present embodiment. In a case where the work device 8 attached to the hydraulic excavator 1 is a work device which has two monitor points whose distance to each other changes (e.g. the secondary crusher 8*c*), the display controller 31 creates a side surface image (guidance image) illustrating a positional relationship between a target surface and the work device 8 in accordance with the flowchart illustrated in FIG. 11.

At Step S21, in a similar manner to Step S1 in the first embodiment, the target-surface information is read in from the storage section 41.

At Step S22, the target-surface FIG. 48 obtained from Step S21, and the work-device position obtained from the work-device-position calculating section 40*c* are used, and arranged in a coordinate system on an image.

Since the coordinate system on the image has the maximum values [px max, py max] in the longitudinal direction and the lateral direction that are defined by the size of a screen of the display section 38, the scale Kscl and the offset OP1 are determined for arranging the entire work device 8 and at least one line segment constituting the target-surface FIG. 48 such that the entire work device 8 and the at least one line segment are included in the screen.

FIG. 12 illustrates the outline of a method of arranging a drawing figure of the secondary crusher 8*c* and the target-surface FIG. 48 in the coordinate system on the image on the basis of the positions of the first monitor point MP1, the second monitor point MP2, the first feature point FP1, the third-link-pin central point LP3, the third-cylinder-pin central point CP3 and the target-surface FIG. 48 on the work-implement operation plane (X-Z plane).

As illustrated in FIG. 12(*a*), a point positioned at the tip of the work-device frame 57 (a point positioned on the contour of the work-device frame 57 projected onto the work-implement operation plane (X-Z plane)) is defined as the first monitor point MP1, a point positioned at the tip of the work-device arm 58 (a point positioned on the contour of the work-device arm 58 projected onto the work-implement operation plane (X-Z plane)) is defined as the second monitor point MP2, and a point at which the central axis of the fourth link pin 59 pivotably coupling the work-device arm 58 to the work-device frame 57 crosses the working-implement operation plane (X-Z plane) is defined as the first feature point FP1.

In order to extract at least one line segment for drawing from the target-surface FIG. 48, the distance between the point MP1 and each of all line segments constituting the target-surface FIG. 48 is calculated, the line segment closest to the target-surface FIG. 48 is defined as the nearest line segment TL1, and the first nearest target-surface point TP1 included in the nearest line segment is acquired.

Next, the maximum value and minimum value, PX max and PX min, and the maximum value and minimum value, PZ max and PZ min, on the work-implement operation plane (X-Z plane) along the X axis and the Z axis, respectively, are acquired from the six points which are the point MP1, the point MP2, the point FP1, the point LP3, the point CP3 and the point TP1.

As illustrated in FIG. 12(*b*), the offset OP1 is calculated according to Formula (1) such that the center of the acquired maximum values and minimum values of the six points is located at the origin.

The scale Kscl is obtained from the minimum value of the quotients of the maximum values [px max, py max] of the size of the screen divided by the differences between the maximum values and the minimum values of the six points on the work-implement operation plane (X-Z plane). The scale Kscl is calculated according to Formula (2).

The point MP1, the point MP2, the point FP1, the point LP3, the point CP3 and the point TP1 of the work-device position and the target-surface FIG. 48 on the work-implement operation plane (X-Z plane) (local coordinate system) are converted into the point mp1, the point mpg, the point fp1, the point lp3, the point cp3 and the point tp1 in the coordinate system on the image according to Formula (3).

At Step S23, the three points which are the point mp1, the point lp3 and the point cp3 indicating the work-device position in the coordinate system on the image calculated at Step S22 are used to perform a process of deforming a first drawing FIG. 65 included in the work-device drawing information which is associated with that the work-device-type information set through the operation section 37 of the display device 19 is about the secondary crusher 8*c*.

The work-device drawing information which is associated with that the work-device-type information is about the secondary crusher 8*c* includes image information on the first drawing FIG. 65 including the three points which are the first monitor point MP1, the third-link-pin central point LP3 and the third-cylinder-pin central point CP3 of the secondary crusher 8*c*, and the coordinate values of the point mp1*a*, the point lp3*a* and the point cp3*a* indicating the positions of the first monitor point MP1, the third-link-pin central point LP3 and the third-cylinder-pin central point CP3, respectively, in a coordinate system on the first drawing FIG. 65.

Figure 13:
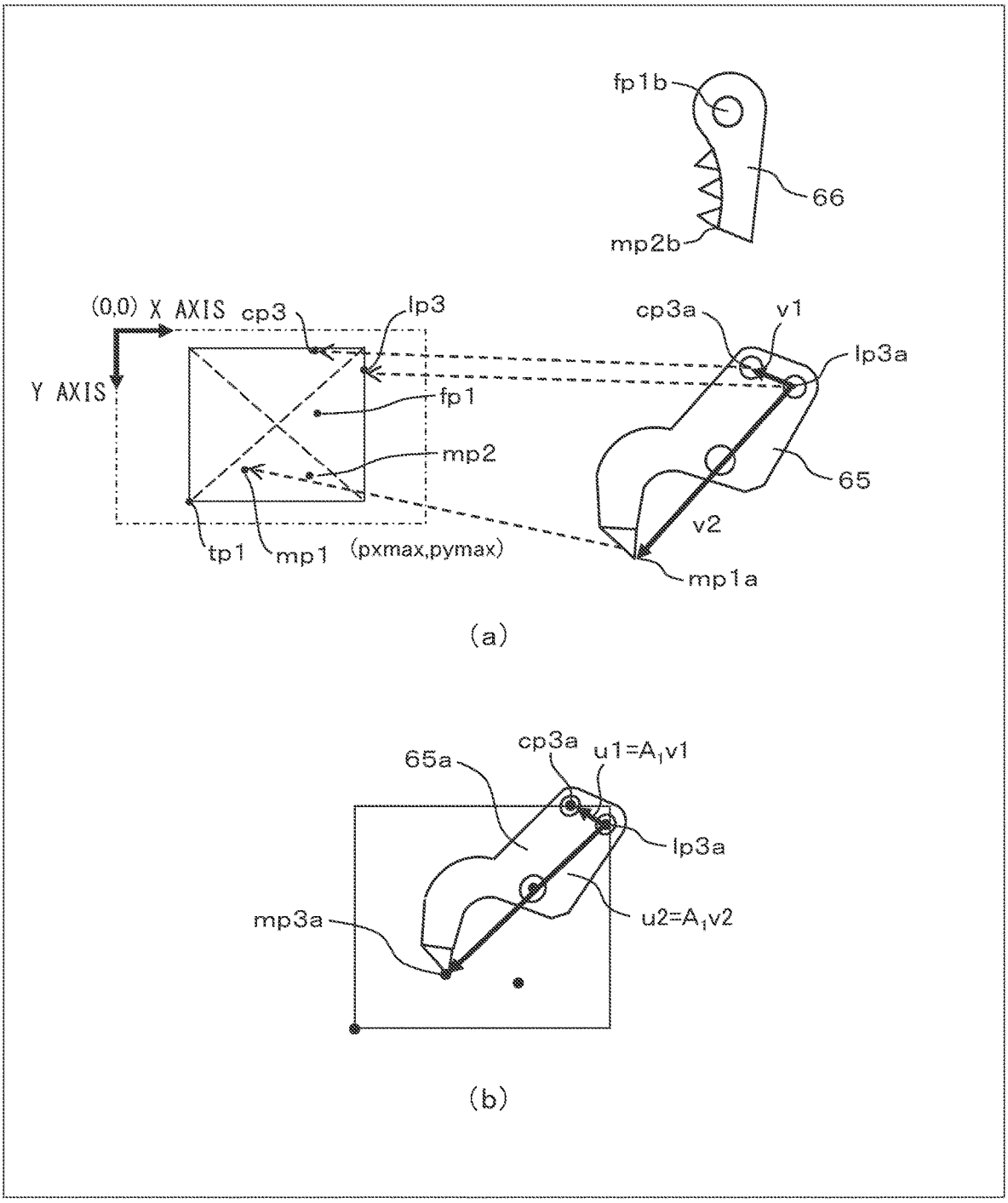
FIG. 13 is a figure illustrating one example of a method of deforming a first drawing figure representing part (work-device frame) of the secondary crusher according to the third embodiment of the present invention.

FIG. 13 illustrates one example of a method of deforming the first drawing FIG. 65 representing part (the work-device frame 57) of the secondary crusher 8*c* on the basis of work-device dimensional information on the actually attached secondary crusher 8*c* and work-device drawing information indicating the secondary crusher 8*c*.

In a similar manner to the first embodiment, linear mapping is used as a technique for a process of deforming the first drawing FIG. 65. Linear mapping is represented by Formula (4).

The image deformation matrix A1 used for linear mapping to convert the first drawing FIG. 65 can be obtained from the work-device dimensional information on the secondary crusher 8*c*, and information on positions at coordinates of the first drawing FIG. 65.

A vector u1 originating at the point lp3 and terminating at the point cp3 is defined as [u1*x*, u1*y*], a vector u2 originating at the point lp3 and terminating at the point mp1 is defined as [u2*x*, u2*y*], a vector v1 originating at the point lp3*a* and terminating at the point cp3*a* is defined as [v1*x*, v1*y*], and a vector v2 originating at the point lp3*a* and terminating at the point mp1*a* is defined as [v2*x*, v2*y*]. According to these definitions, the image deformation matrix A1 is represented by Formulae (5) to (8).

It should be noted, however, that the case where there is the inverse matrix $P1^{-1}$ of the matrix P1 is the case where the matrix P1 is a regular matrix, and in a case where the determinant of the matrix P1 is 0 as an exemplary case where the matrix P1 is decided as not a regular matrix, the process does not proceed to Step S24, but the calculation of the drawing calculating section 40*d* ends.

Figure 14:
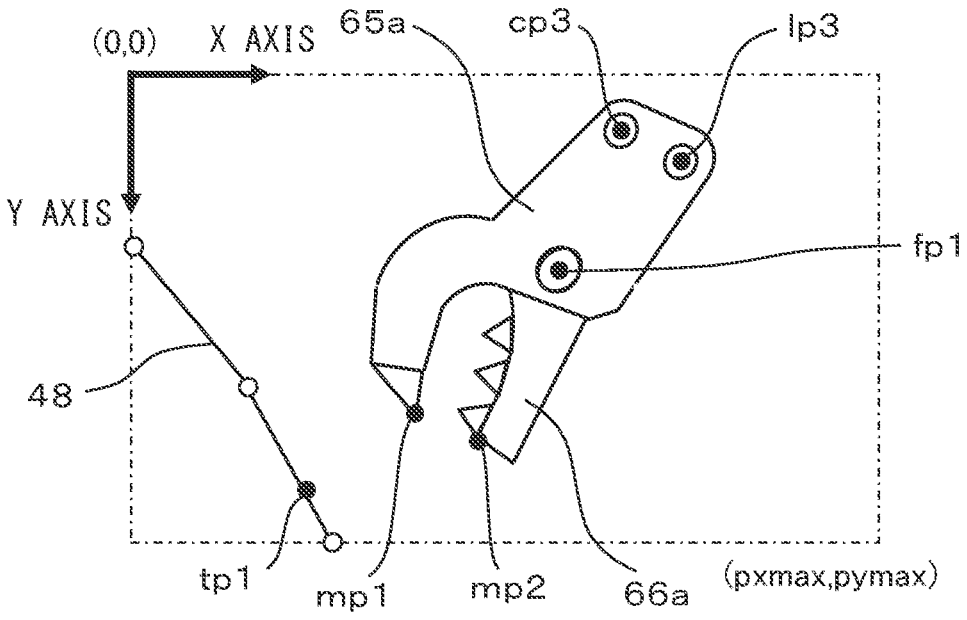
FIG. 14 is a figure illustrating a state where first and second post-deformation drawing figures representing the secondary crusher are arranged in a drawing image according to the third embodiment of the present invention.

In a case where the matrix P1 is a regular matrix, and there is the inverse matrix $P1^{-1}$ of the matrix P1, the image deformation matrix A1 obtained according to Formula (8) is used to deform the first drawing FIG. 65 of the secondary crusher 8*c*, and create a first post-deformation drawing FIG. 65*a* (illustrated in FIG. 13(*b*) or FIG. 14), and the process proceeds to Step S24.

At Step S24, the two points which are the point mpg and the point fp1 indicating the work-device position in the coordinate system on the image calculated at Step S22 are used to perform a process of deforming a second drawing FIG. 66 included in the work-device drawing information which is associated with that the work-device-type information set through the operation section 37 of the display device 19 is about the secondary crusher 8*c*.

The work-device drawing information which is associated with that the work-device-type information is about the secondary crusher 8*c* includes image information on the second drawing FIG. 66 including the two points which are the second monitor point MP2 and the first feature point FP1 of the secondary crusher 8*c*, and the coordinate values of the point mp2*b* and the point fp1*b* indicating the positions of the second monitor point MP2 and the first feature point FP1, respectively, in a coordinate system on the second drawing FIG. 66.

In the process of deforming the second drawing FIG. 66, the length of a line segment linking the point mp2*b* and the point fp1*b* is divided by the length of a line segment linking the point mpg and the point fp1, and the quotient is used for reducing or increasing the size of the second drawing FIG. 66 such that the aspect ratio of the second drawing FIG. 66 remains unchanged to create a second post-deformation drawing FIG. 66*a* (illustrated in FIG. 14).

At Step S25, a drawing image is created on the screen of the display section 38 on the basis of the first and second post-deformation drawing FIGS. 65*a* and 66*a* of the secondary crusher 8*c* obtained at Steps S23 and S24, and the arrangement of the work device 8 and the target-surface FIG. 48 on a drawing screen obtained from Step S22.

FIG. 14 illustrates a state where the first and second post-deformation drawing FIGS. 65*a* and 66*a* representing the secondary crusher 8*c* are arranged in the drawing image.

The first post-deformation drawing FIG. 65*a* of the secondary crusher 8*c* is arranged in the drawing image with the three points which are the point mp1*a*, the point lp3*a* and the point cp3*a* included in the image being arranged correspondingly to the corresponding three points which are the point mp1, the point lp3 and the point cp3 of the work-device position included in the drawing image.

The second post-deformation drawing FIG. 66*a* of the secondary crusher 8*c* is arranged in the drawing image with the two points which are the point mp2*b* and the point fp1*b* included in the image being arranged correspondingly to the corresponding two points which are the point mpg and the point fp1 of the work-device position included in the drawing image.

A range of the image of the target-surface FIG. 48 that fits in the screen is drawn, in a similar manner to the first embodiment.

In this manner, in the present embodiment, the work device 8 has the base portion 57 including the first coupling point LP3, the second coupling point CP3 and the first monitor point MP1, and the first driven portion 58 attached pivotably to the base portion 57 via the third coupling pin 59, the construction machine 1 further includes the first posture sensor 64 that senses the posture of the first driven portion 58, the dimensional information on the work device 8 further includes positional information on the first feature point FP1 positioned on the central axis of the third coupling pin 59 and the second monitor point MP2 positioned at the tip of the first driven portion 58, the drawing information on the work device 8 further includes image information on the second drawing FIG. 66 representing the first driven portion 58 including the first feature point FP1 and the second monitor point MP2, the work-device-position calculating section 40*c* calculates the coordinate values of each of the first feature point FP1 and the second monitor point MP2 on the basis of the dimensional information on the work device 8 and the posture of the first driven portion 58 sensed by the first posture sensor 64, and the drawing calculating section 40*d* deforms the second drawing FIG. 66 to create the second post-deformation drawing FIG. 66*a* such that the length of a line segment linking the first feature point FP1 and the second monitor point MP2 in the second drawing FIG. 66 matches the length of a line segment linking the first feature point FP1 and the second monitor point MP2 in the coordinate system on the image on the display device 19, and arranges the second post-deformation drawing FIG. 66*a* on the screen of the display device 19 such that the positions of the first feature point FP1 and the second monitor point MP2 in the second post-deformation drawing FIG. 66*a* are arranged correspondingly to the positions of the first feature point FP1 and the second monitor point MP2, respectively, in the coordinate system on the image.

According to the thus-configured hydraulic excavator 1 according to the present embodiment, it becomes possible to display a work device 8 having one driven portion (e.g. the secondary crusher 8*c*) on the display device 19 without causing a sense of discomfort.

Note that although the secondary crusher 8*c* is illustrated as an example of the work device 8 in the present embodiment, the work device 8 is not limited as long as the work device 8 includes: a base portion including the third link pin 22, the third cylinder pin 44 and at least one monitor point; a driven portion that includes at least one monitor point, and pivots about one certain point, and a drive portion for the driven portion; and the secondary crusher 8*c* may be replaced with a hydraulic pressure cutter and the like with the same structure.

In addition, although the first drawing FIG. 65 which is an image of the base portion including the third link pin 22, the third cylinder pin 44 and at least one monitor point of the work device 8, and the second drawing FIG. 66 which is an image of a driven portion that includes at least one monitor point and pivots about one certain point are drawn in the present embodiment, a drive portion such as a hydraulic cylinder may be drawn further, for example.

Fourth Embodiment

The hydraulic excavator 1 according to a fourth embodiment of the present invention is explained by using FIG. 15 to FIG. 18. The hydraulic excavator 1 according to the present embodiment includes a primary crusher as the work device 8.

Figure 16:
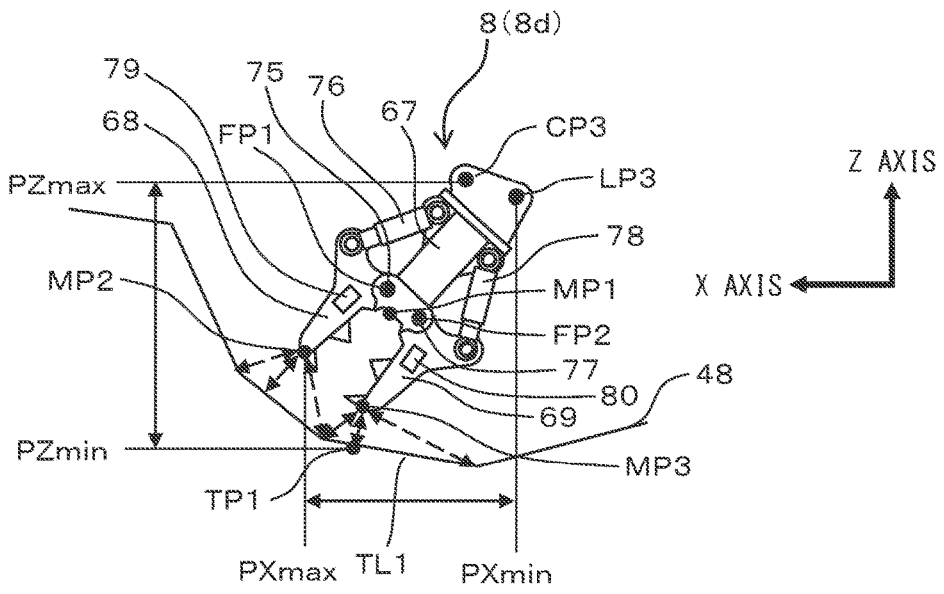
FIG. 16 is a figure illustrating an outline of a method of arranging a drawing figure of a primary crusher and a target-surface figure in a coordinate system on an image according to the fourth embodiment of the present invention.
Figure 16:
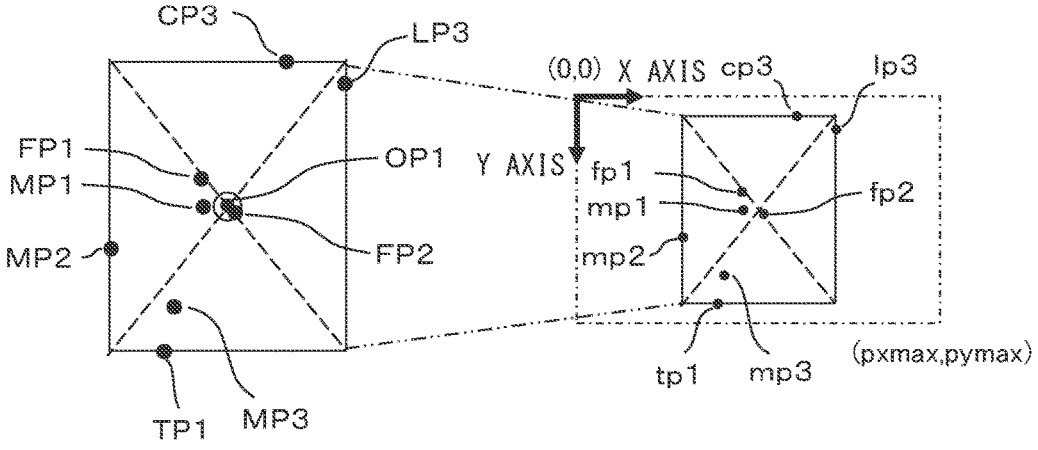

Differences from the first embodiment are as follows: as illustrated in FIG. 16(*a*), a primary crusher 8*d* as the work device 8 has one work-device frame (base portion) 67 and a pair of first and second work-device arms (first and second driven portions) 68 and 69, the work-device frame 67 includes therein the first monitor point MP1, and the first and second work-device arms 68 and 69 include the second and third monitor points MP2 and MP3, respectively; the second monitor point MP2 exhibits a rotational movement about the first feature point FP1 in terms of the structure included in the work-device frame 67, and the third monitor point MP3 exhibits a rotational movement about a second feature point FP2 in terms of the structure included in the work-device frame 67; and three drawing figures to be used in drawing the work device 8 are included.

The first work-device arm 68 is pivotably connected to the work-device frame 67 via a fourth link pin 75, and is driven by a fourth cylinder 76. Similarly, the second work-device arm 69 is pivotably connected to the work-device frame 67 via a fifth link pin (fourth coupling pin) 77, and is driven by a fifth cylinder 78. That is, the first feature point FP1 is a point on the central axis of the fourth link pin 75, and the second feature point FP2 is a point on the central axis of the fifth link pin 77. As first and second posture sensors to sense the postures of the first and second work-device arms 68 and 69, respectively, fourth and fifth rotation-angle sensors 79 and 80 are attached to the first and second work-device arms 68 and 69. The fourth and fifth rotation-angle sensors 79 and 80 are IMUs, for example, which are attached to the first and second work-device arms 68 and 69, respectively, sense the angle around the fourth link pin 75 formed between the first work-device arm 68 and the vertical (gravity) direction, and the angle around the fifth link pin 77 formed between the second work-device arm 69 and the vertical (gravity) direction, and output the angle of the first work-device arm 68 relative to the work-device frame 67, and the angle of the second work-device arm 69 relative to the work-device frame 67, respectively.

In addition to the calculation in the first embodiment, further on the basis of angle signals of the fourth and fifth rotation-angle sensors 79 and 80, and the angle conversion parameter in the storage section 41, the posture calculating section 40*b* (illustrated in FIG. 3) calculates angles θ4 and θ5 around the fourth and fifth link pins 75 and 77 of the first and second work-device arms 68 and 69 relative to the work-device frame 67.

In addition to the calculation in the first embodiment, on the basis of the angles θ4 and θ5 calculated at the posture calculating section 40*b*, the work-device-position calculating section 40*c* (illustrated in FIG. 3) further calculates the positions of the second and third monitor points MP2 and MP3 included in the first and second work-device arms 68 and 69, and the first and second feature points FP1 and FP2 in terms of the structure included in the work-device frame 67, the positions being calculated in terms of the work-implement operation plane (X-Z plane) and in terms of the global coordinate system.

In a similar manner to the first embodiment, on the basis of information on the type and dimensions of the work device that are set through the operation section 37 of the display device 19, a result of calculation performed by the work-device-position calculating section 40*c*, and the target-surface information and work-device drawing information in the storage section 41, the drawing calculating section 40*d* (illustrated in FIG. 3) creates a guidance image.

Figure 15:
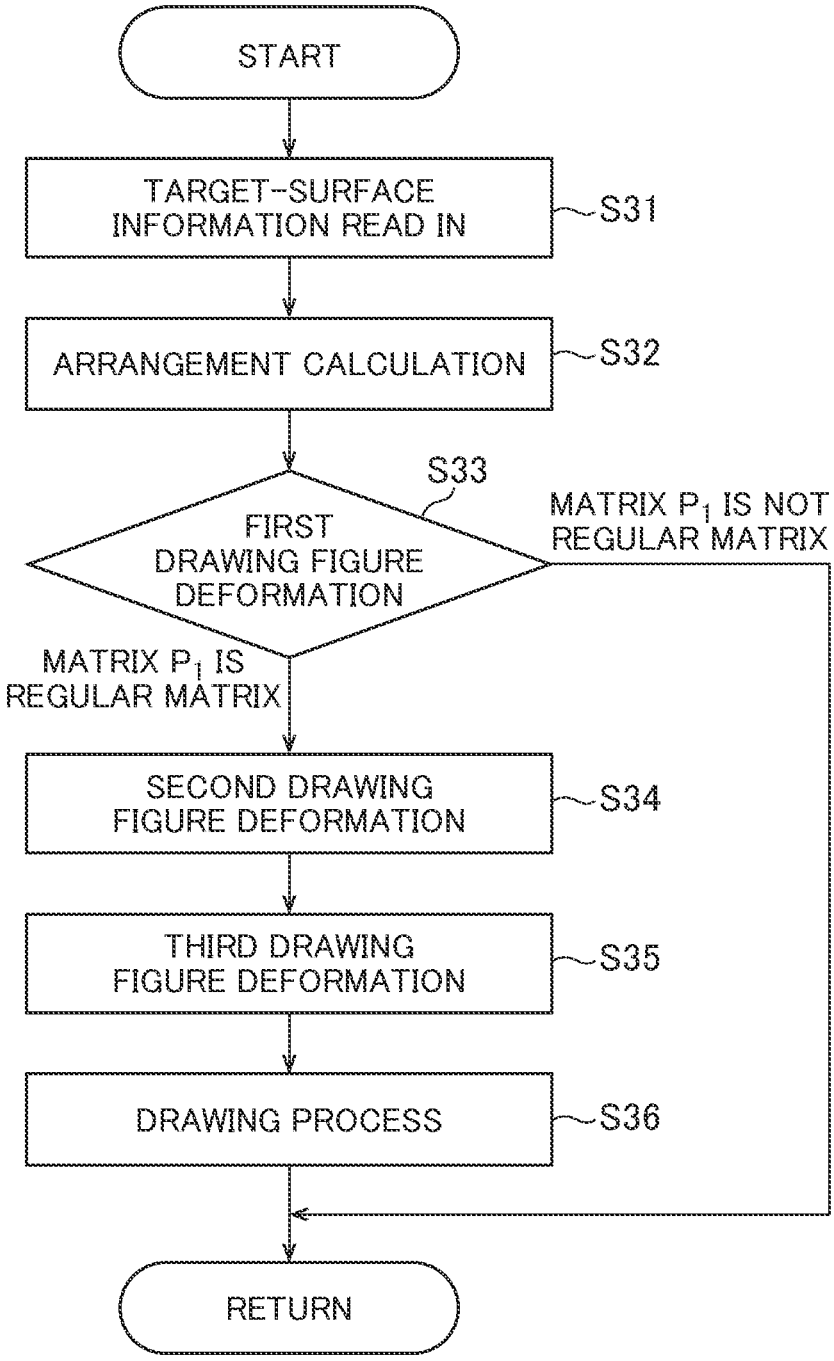
FIG. 15 is a flowchart illustrating one example of a drawing-calculation process performed by a display controller according to a fourth embodiment of the present invention.

FIG. 15 is a flowchart illustrating one example of a drawing-calculation process performed by the display controller 31 according to the present embodiment. In a case where the work device 8 attached to the hydraulic excavator 1 is a work device which has three monitor points whose distances to each other change (e.g. the primary crusher 8*d*), the display controller 31 creates a side surface image (guidance image) illustrating a positional relationship between a target surface and the work device 8 in accordance with the flowchart illustrated in FIG. 15.

At Step S31, in a similar manner to Step S1 in the first embodiment, the target-surface information is read in from the storage section 41.

At Step S32, the target-surface FIG. 48 obtained from Step S31, and the work-device position obtained from the work-device-position calculating section 40*c* are used and arranged in a coordinate system on an image.

Since the coordinate system on the image has the maximum values [px max, py max] in the longitudinal direction and the lateral direction that are defined by the size of a screen of the display section 38, the scale Kscl and the offset OP1 are determined for arranging the entire work device 8 and at least one line segment constituting the target-surface FIG. 48 such that the entire work device 8 and the at least one line segment are included in the screen.

FIG. 16 illustrates the outline of a method of arranging a drawing figure of the primary crusher 8*d* and the target-surface FIG. 48 in the coordinate system on the image on the basis of the positions of the first to third monitor points MP1 to MP3, the first and second feature points FP1 and FP2, the third-link-pin central point LP3, the third-cylinder-pin central point CP3 and the target-surface FIG. 48 on the work-implement operation plane (X-Z plane).

As illustrated in FIG. 16(*a*), a point positioned at the tip of the work-device frame 67 (a point positioned on the contour of the work-device frame 67 projected onto the work-implement operation plane (X-Z plane)) is defined as the first monitor point MP1, points positioned at the tips of the first and second work-device arms 68 and 69, respectively (points positioned on the contours of the first and second work-device arms 68 and 69, respectively, projected onto the work-implement operation plane (X-Z plane)) are defined as the second and third monitor points MP2 and MP3, respectively, a point at which the central axis of the fourth link pin 75 pivotably coupling the first work-device arm 68 to the work-device frame 67 crosses the working-implement operation plane (X-Z plane) is defined as the first feature point FP1, and a point at which the central axis of the fifth link pin 77 pivotably coupling the second work-device arm 69 to the work-device frame 67 crosses the working-implement operation plane (X-Z plane) is defined as the second feature point FP2.

In order to extract at least one line segment for drawing from the target-surface FIG. 48, the distance between each of the point MP1, the point MP2 and the point MP3, and each of all line segments constituting the target-surface FIG. 48 is calculated, the line segment closest to the target-surface FIG. 48 is defined as the nearest line segment TL1, and the first nearest target-surface point TP1 included in the nearest line segment is acquired.

Next, the maximum value and minimum value, PX max and PX min, and the maximum value and minimum value, PZ max and PZ min, on the work-implement operation plane (X-Z plane) along the X axis and the Z axis, respectively, are acquired from the eight points which are the point MP1, the point MP2, the point MP3, the point FP1, the point FP2, the point LP3, the point CP3 and the point TP1.

As illustrated in FIG. 16(*b*), the offset OP1 is calculated according to Formula (1) such that the center of the acquired maximum values and minimum values of the eight points is located at the origin.

The scale Kscl is obtained from the minimum value of the quotients of the maximum values [px max, py max] of the size of the screen divided by the differences between the maximum values and the minimum values of the eight points on the work-implement operation plane (X-Z plane). The scale Kscl is calculated according to Formula (2).

The point MP1, the point MP2, the point MP3, the point FP1, the point FP2, the point LP3, the point CP3 and the point TP1 of the work-device position and the target-surface FIG. 48 on the work-implement operation plane (X-Z plane) (local coordinate system) are converted into the point mp1, the point mpg, the point mp3, the point fp1, the point fp2, the point lp3, the point cp3 and the point tp1, respectively, in the coordinate system on the image according to Formula (3).

At Step S33, the three points which are the point mp1, the point lp3 and the point cp3 indicating the work-device position in the coordinate system on the image calculated at Step S32 are used to perform a process of deforming a first drawing FIG. 81 included in the work-device drawing information which is associated with that the work-device-type information set through the operation section 37 of the display device 19 is about the primary crusher 8*d*.

The work-device drawing information which is associated with that the work-device-type information is about the primary crusher 8*d* includes image information on the first drawing FIG. 81 including the first monitor point MP1, the third-link-pin central point LP3 and the third-cylinder-pin central point CP3, and representing part of the primary crusher 8*d*, and the coordinate values of the point mp1*a*, the point lp3*a* and the point cp3*a* indicating the positions of the first monitor point MP1, the third-link-pin central point LP3 and the third-cylinder-pin central point CP3, respectively, in a coordinate system on the first drawing FIG. 81.

Figure 17:
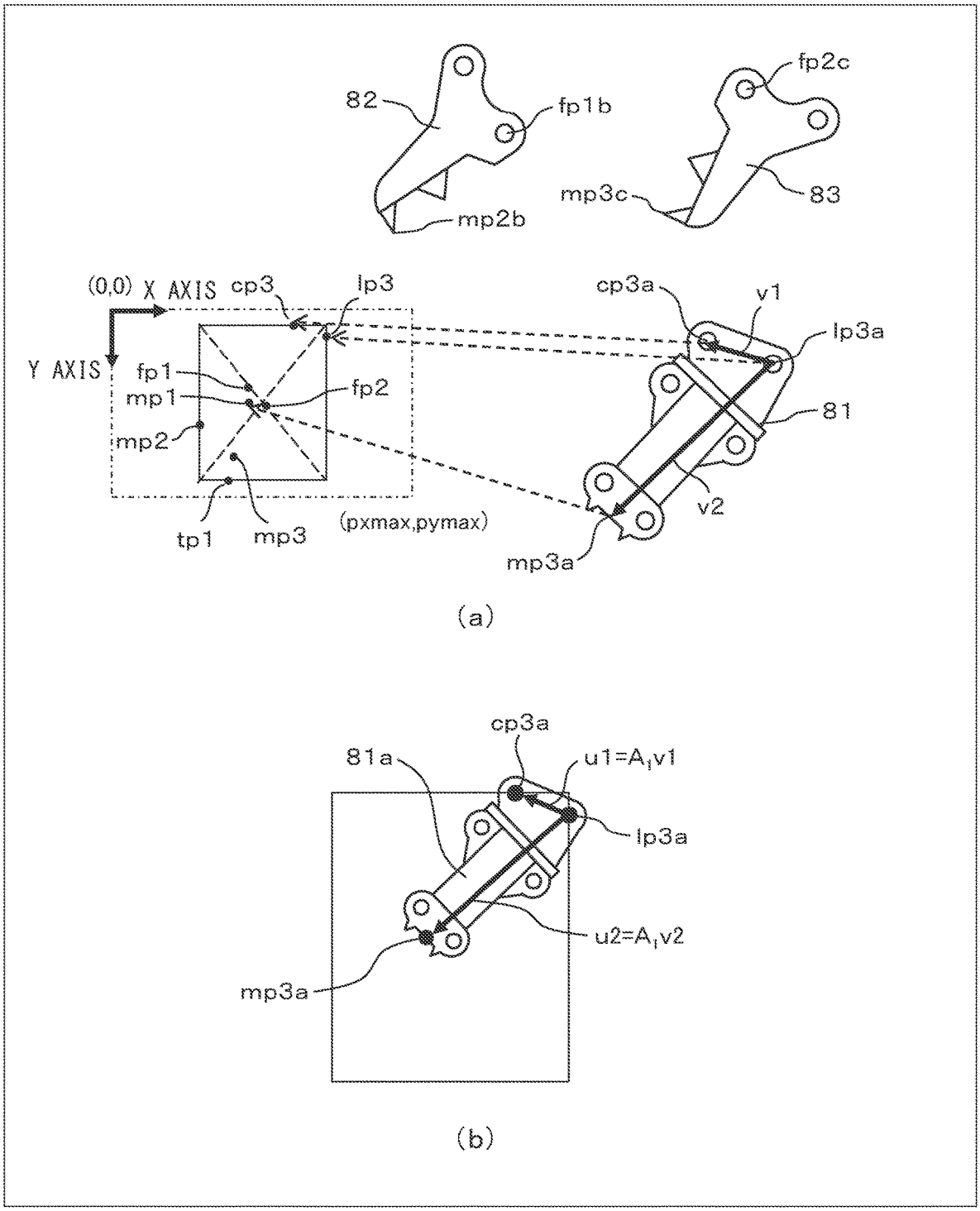
FIG. 17 is a figure illustrating one example of a method of deforming a first drawing figure representing part (work-device frame) of the primary crusher according to the fourth embodiment of the present invention.

FIG. 17 illustrates one example of a method of deforming the first drawing FIG. 81 representing part (the work-device frame 67) of the primary crusher 8*d* on the basis of work-device dimensional information on the actually attached primary crusher 8*d* and work-device drawing information indicating the primary crusher 8*d*.

In a similar manner to the first embodiment, linear mapping is used as a technique for a process of deforming the first drawing FIG. 81. Linear mapping is represented by Formula (4).

The image deformation matrix A1 used for linear mapping to convert the first drawing FIG. 81 can be obtained from the work-device dimensional information on the primary crusher 8*d*, and information on positions at coordinates of the first drawing FIG. 81.

A vector u1 originating at the point lp3 and terminating at the point cp3 is defined as [u1*x*, u1*y*], a vector u2 originating at the point lp3 and terminating at the point mp1 is defined as [u2*x*, u2*y*], a vector v1 originating at the point lp3*a* and terminating at the point cp3*a* is defined as [v1*x*, v1*y*], and a vector v2 originating at the point lp3*a* and terminating at the point mp1*a* is defined as [v2*x*, v2*y*]. According to these definitions, the image deformation matrix A1 is represented by Formulae (5) to (8).

It should be noted, however, that the case where there is the inverse matrix $P1^{-1}$ of the matrix P1 is the case where the matrix P1 is a regular matrix, and in a case where the determinant of the matrix P1 is 0 as an exemplary case where the matrix P1 is decided as not a regular matrix, the process does not proceed to Step S34, but the calculation of the drawing calculating section 40*d* ends.

Figure 18:
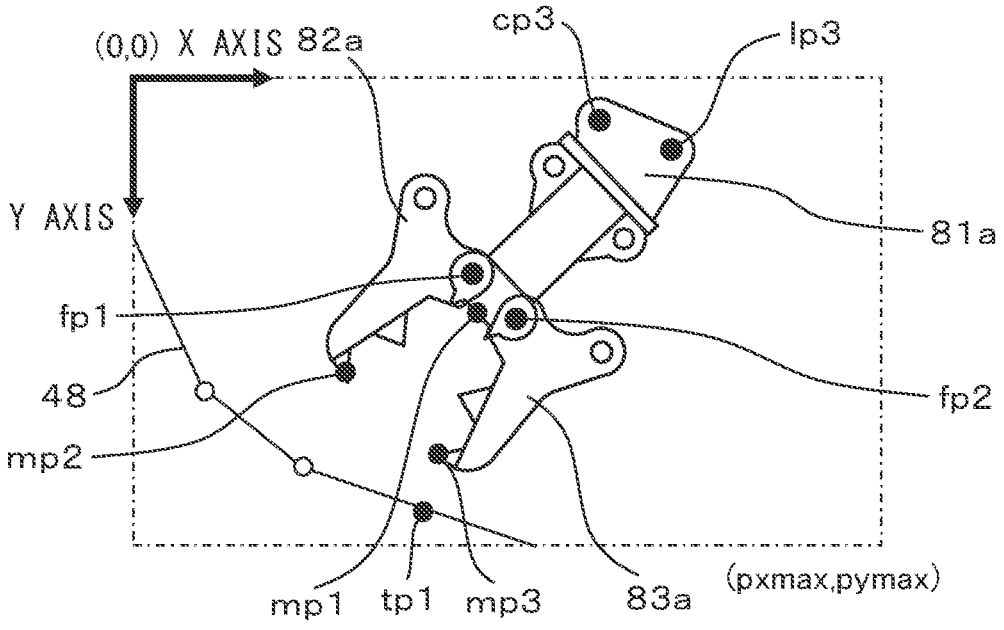
FIG. 18 is a figure illustrating a state where first to third post-deformation drawing figures representing the primary crusher are arranged in a drawing image according to the fourth embodiment of the present invention.

In a case where the matrix P1 is a regular matrix, and there is the inverse matrix $P1^{-1}$ of the matrix P1, the image deformation matrix A1 obtained according to Formula (8) is used to deform the first drawing FIG. 81 of the primary crusher 8*d*, and create a first post-deformation drawing FIG. 81*a* (illustrated in FIG. 17(*b*) or FIG. 18), and the process proceeds to Step S34.

At Step S34, the two points which are the point mp2 and the point fp1 indicating the work-device position in the coordinate system on the image calculated at Step S32 are used to perform a process of deforming a second drawing FIG. 82 included in the work-device drawing information which is associated with that the work-device-type information set through the operation section 37 of the display device 19 is about the primary crusher 8*d*.

The work-device drawing information which is associated with that the work-device-type information is about the primary crusher 8*d* includes image information on the second drawing FIG. 82 including the two points which are the second monitor point MP2 and the first feature point FP1 of the primary crusher 8*d*, and the coordinate values of the point mp2*b* and the point fp1*b* indicating the positions of the second monitor point MP2 and the first feature point FP1, respectively, in a coordinate system on the second drawing FIG. 82.

In the process of deforming the second drawing FIG. 82, the length of a line segment linking the point mp2*b* and the point fp1*b* is divided by the length of a line segment linking the point mp2 and the point fp1, and the quotient is used for reducing or increasing the size of the second drawing FIG. 82 such that the aspect ratio of the second drawing FIG. 82 remains unchanged.

At Step S35, the two points which are the point mp3 and the point fp2 indicating the work-device position in the coordinate system on the image calculated at Step S32 are used to perform a process of deforming a third drawing FIG. 83 included in the work-device drawing information which is associated with that the work-device-type information set through the operation section 37 of the display device 19 is about the primary crusher 8*d*.

The work-device drawing information which is associated with that the work-device-type information is about the primary crusher 8*d* includes image information on the third drawing FIG. 83 including the two points which are the third monitor point MP3 and the second feature point FP2 of the primary crusher 8*d*, and the coordinate values of the point mp3*c* and the point fp2*c* indicating the positions of the third monitor point MP3 and the second feature point FP2, respectively, in a coordinate system on the third drawing FIG. 83.

In the process of deforming the third drawing FIG. 83, the length of a line segment linking the point mp3*c* and the point fp2*c* is divided by the length of a line segment linking the point mp3 and the point fp2, and the quotient is used for reducing or increasing the size of the third drawing FIG. 83 such that the aspect ratio of the third drawing FIG. 83 remains unchanged.

At Step S36, a drawing image is created on the screen of the display section 38 on the basis of the first to third post-deformation drawing FIGS. 81*a* to 83*a* of the primary crusher 8*d* obtained at Steps S33, S34 and S35, and the arrangement of the work device 8 and the target-surface FIG. 48 on a drawing screen obtained from Step S32.

FIG. 18 illustrates a state where the first to third post-deformation drawing FIGS. 81*a* to 83*a* representing the primary crusher 8*d* are arranged in the drawing image.

The first post-deformation drawing FIG. 81*a* of the primary crusher 8*d* is arranged in the drawing image with the three points which are the point mp1*a*, the point lp3*a* and the point cp3*a* (illustrated in FIG. 17(*a*)) included in the image being arranged correspondingly to the corresponding three points which are the point mp1, the point lp3 and the point cp3 (illustrated in FIG. 17(*a*)) of the work-device position included in the drawing image.

The second post-deformation drawing FIG. 82*a* of the primary crusher 8*d* is arranged in the drawing image with the two points which are the point mp2*b* and the point fp1*b* included in the drawing figure being arranged correspondingly to the corresponding two points which are the point mpg and the point fp1 of the work-device position included in the drawing image.

The third post-deformation drawing FIG. 83*a* of the primary crusher 8*d* is arranged in the drawing image with the two points which are the point mp3*c* and the point fp2*c* included in the drawing figure being arranged correspondingly to the corresponding two points which are the point mp3 and the point fp2 of the work-device position included in the drawing image.

A range of the image of the target-surface FIG. 48 that fits in the screen is drawn, in a similar manner to the first embodiment.

In this manner, in the present embodiment, the work device 8 further has the second driven portion 69 attached pivotably to the base portion 67 via the fourth coupling pin 77, the construction machine 1 further includes the second posture sensor 80 that senses the posture of the second driven portion 69, the dimensional information on the work device 8 further includes positional information on the second feature point FP2 positioned on the central axis of the fourth coupling pin 77 and the third monitor point MP3 positioned at the tip of the second driven portion 69, the drawing information on the work device 8 further includes image information on the third drawing FIG. 83 representing the second driven portion 69 including the second feature point FP2 and the third monitor point MP3, the work-device-position calculating section 40*c* calculates the coordinate values of each of the first feature point FP1 and the third monitor point MP3 on the basis of the dimensional information on the work device 8 and the posture of the second driven portion 69 sensed by the second posture sensor 80, and the drawing calculating section 40*d* deforms the third drawing FIG. 83 to create the third post-deformation drawing FIG. 83*a* such that the length of a line segment linking the second feature point FP2 and the third monitor point MP3 in the drawing figure matches the length of a line segment linking the second feature point FP2 and the third monitor point MP3 in the coordinate system on the image on the display device 19, and the drawing calculating section 40*d* arranges the third post-deformation drawing FIG. 83*a* on the screen of the display device 19 such that the positions of the second feature point FP2 and the third monitor point MP3 in the third post-deformation drawing FIG. 83*a* are arranged correspondingly to the positions of the second feature point FP2 and the third monitor point MP3, respectively, in the coordinate system on the image.

According to the thus-configured hydraulic excavator 1 according to the present embodiment, it becomes possible to display a work device 8 having two driven portions (e.g. the primary crusher 8*d*) on the display device 19 without causing a sense of discomfort.

Note that although the primary crusher 8*d* is illustrated as an example of the work device 8 in the present embodiment, the work device 8 is not limited as long as the work device 8 includes a base portion including the third link pin 22, the third cylinder pin 44 and at least one monitor point, two driven portions each of which includes at least one monitor point, and pivots about one certain point, and a drive portion for the driven portion, and the primary crusher 8*d* may be replaced with a grapple and the like.

In addition, although the first drawing FIG. 81 which is an image of the base portion including the third link pin 22, the third cylinder pin 44 and at least one monitor point of the work device 8, and the second and third drawing FIGS. 82 and 83 which are images of two driven portions that include at least one monitor point and pivots about one certain point are drawn in the present embodiment, a drive portion such as a hydraulic cylinder may be drawn, for example.

Fifth Embodiment

Figure 19:
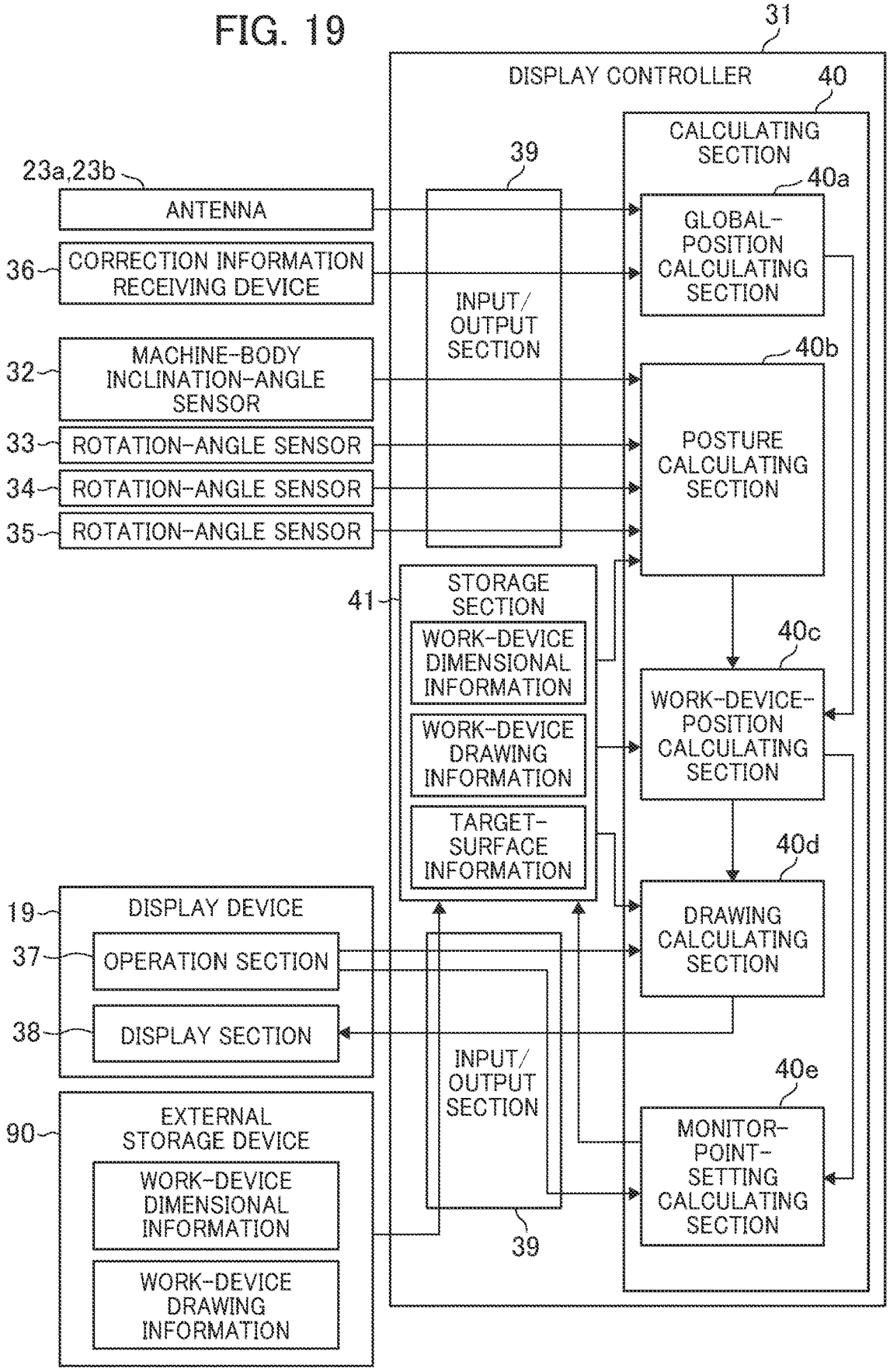
FIG. 19 is a block diagram illustrating a configuration of the calculating section of a display controller according to a fifth embodiment of the present invention.
Figure 20:
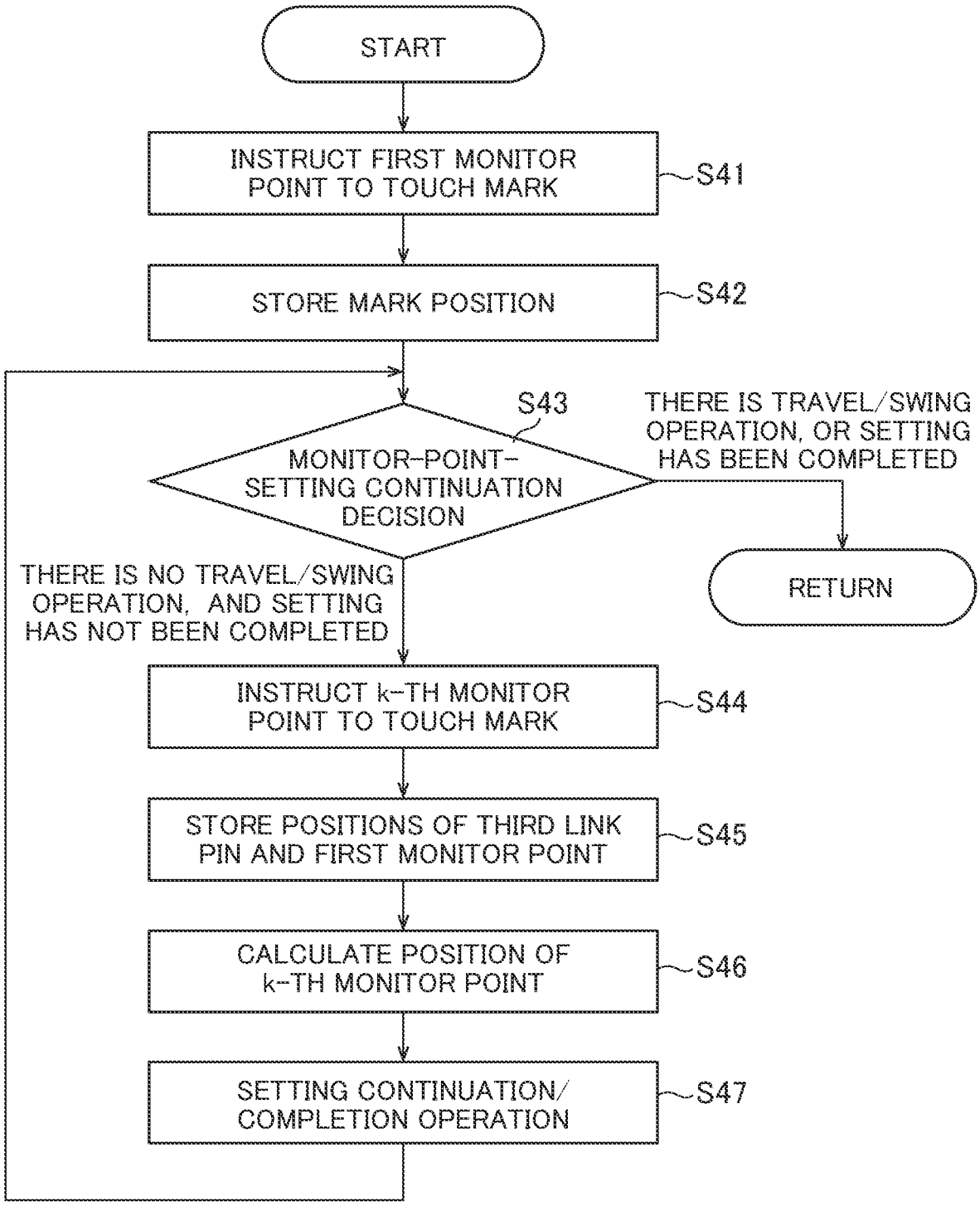
FIG. 20 is a flowchart illustrating one example of a monitor-point-setting-calculation process performed by the display controller according to the fifth embodiment of the present invention.
Figure 21:
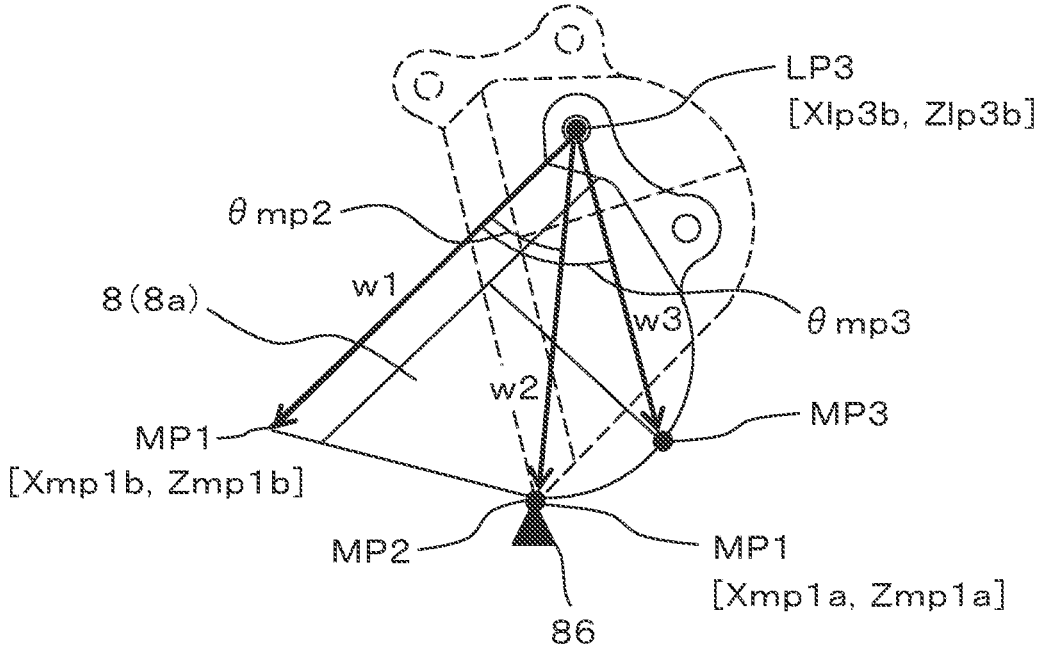
FIG. 21 is a figure illustrating a state where the positions of first and second monitor points of a bucket are aligned with the position of a fixed mark according to the fifth embodiment of the present invention.

The hydraulic excavator 1 according to a fifth embodiment of the present invention is explained by using FIG. 19 to FIG. 21. The hydraulic excavator 1 according to the present embodiment includes a bucket as the work device 8 in a similar manner to the second embodiment.

Although a method of setting at least one monitor point other than the first monitor point MP1 inside the work device 8 is omitted in the second embodiment, an easy method of setting at least one monitor point other than the first monitor point MP1 is explained in the present embodiment.

FIG. 19 is a block diagram illustrating the configuration of the calculating section 40 of the display controller 31 according to the present embodiment.

As illustrated in FIG. 19, the calculating section 40 of the display controller 31 further has a monitor-point-setting calculating section 40*e*.

On the basis of the type of a work device set through the operation section 37 of the display device 19, information on the dimensions of the boom 6, the arm 7 and the work device 8 related to the first monitor point MP1, the length Lmp1 from the third-link-pin central point LP3 to the first monitor point MP1 and the like, and furthermore a result of calculation performed by the work-device-position calculating section 40*c*, the monitor-point-setting calculating section 40*e* sets information on the dimension of at least one monitor point other than the first monitor point MP1.

FIG. 20 is a flowchart illustrating one example of a monitor-point-setting-calculation process performed by the display controller 31 according to the present embodiment. In a case where the work device 8 attached to the hydraulic excavator 1 has a plurality of monitor points, and dimensional information on one monitor point (first monitor point MP1) of the plurality of monitor points has already been set, and dimensional information on the other monitor points has not been set yet, the display controller 31 sets the unset dimensional information on the monitor points in accordance with the flowchart illustrated in FIG. 20.

At Step S41, in response to reception of a signal to start a setting-calculation process for a monitor point from the operation section 37, it is displayed on the display section 38 that the first monitor point MP1 should be caused to touch a fixed mark 86 that does not move even if the fixed mark 86 is contacted by the work device 8.

At Step S42, in response to reception of a signal, from the operation section 37, the signal indicating that an operator has checked that the first monitor point MP1 and the mark 86 are in contact with each other, the work-device-position calculating section 40*c* calculates the position of the first monitor point MP1 on the work-implement operation plane (X-Z plane), stores, in the storage section 41, a position [Xmp1*a*, Zmp1*a*] of the mark 86 in contact with the first monitor point MP1, and displays, on the display section 38, a warning that nothing other than the work implement 3 should be moved during the subsequent operation until the setting-calculation process for the monitor point ends, in order for the positional relationship between the mark 86 and the center of the first link pin 20, which is the origin, to remain unchanged.

At Step S43, a setting process for at least one monitor point other than the first monitor point MP1, a k-th monitor point (the initial value of k is 2) is started.

Monitoring by the operation-amount sensing section of the machine-body operation device 18 is started, and in a case where operation to drive the swing motor 13 or the travel motor 16*a* or 16*b* is sensed, the process ends without setting a monitor point.

In a case where a signal indicating that setting of the monitor point has been completed is received from the operation section 37, the set monitor point is stored in the storage section 41, and the process ends.

In other cases than the cases explained above, the process is continued.

At Step S44, it is displayed on the display section 38 that a k-th monitor point, here a point inside the work device 8 that is to be set as the second monitor point MP2, should be caused to touch the mark 86.

At Step S45, in response to reception of a signal, from the operation section 37, the signal indicating that the operator has checked that the second monitor point MP2 and the mark 86 are in contact with each other, the work-device-position calculating section 40*c* calculates the positions of the third-link-pin central point LP3 and the first monitor point MP1 on the work-implement operation plane (X-Z plane), and stores, in the storage section 41, the position [Xlp3*b*, Zlp3*b*] of the third-link-pin central point LP3, and the position [Xmp1*b*, Zmp1*b*] of the first monitor point MP1.

At Step S46, on the basis of the position of the mark 86 stored at Step S42, and the positions of the third link pin LP3 and the first monitor point MP1 stored at Step S45, the position of the second monitor point MP2 inside the work device 8 is calculated.

In FIG. 21, the work device 8 in a case where the position of the first monitor point MP1 is aligned with the position of the fixed mark 86 is indicated by broken lines, and the work device 8 in a case where the position of the second monitor point MP2 is aligned with the position of the mark 86 is indicated by solid lines.

The vector originating at the third-link-pin central point LP3 and terminating at the first monitor point MP1 is defined as w1, the vector originating at the third-link-pin central point CP3 and terminating at the second monitor point MP2 is defined as w2, and the monitor-point-setting calculating section 40*e* calculates the position of the second monitor point MP2 inside the work device 8 as a length Lmp2 of the vector w2, and an angle θmp2 formed between the vectors w1 and w2.

The length Lmp2 of the vector w2 is represented by the following formula.

[Equation 9]

$$Lmp2=|w2|=\sqrt{(Xmp1a^2-Xlp3b^2)+(Zmp1a^2-Zlp3b^2)} \tag{9}$$

In addition, the angle θmp2 formed between the vector w1 and w2 is represented by the following formula using the inner product.

[Equation 10]

$$\theta mp2 = \cos^{-1}\left(\frac{w1\cdot w2}{|w1||w2|}\right)=\cos^{-1}\left(\frac{(Xmp1b-Xlp3b)(Xmp1a-Xlp3b)+(Zmp1b-Zlp3b)(Zmp1a-Zlp3b)}{Lmp1\cdot Lmp2}\right) \tag{10}$$

At Step S47, it is displayed on the display section 38 that a signal indicating that setting of a monitor point is to be further performed or setting of monitor points has been completed should be input through the operation section 37, and an input through the operation section 37 is waited for. In a case where a monitor point is set further, the numerical value of k is increased by 1.

In the present embodiment, in order to set the third monitor point MP3, here, a signal indicating that setting of a monitor point is to be further performed is input.

A setting process for the third monitor point MP3 is also performed in a similar manner to the setting process for the second monitor point MP2.

At Step S45, in response to reception of a signal, from the operation section 37, the signal indicating that the operator has checked that the third monitor point MP3 and the mark 86 are in contact with each other, the work-device-position calculating section 40*c* calculates the positions of the third link pin 22 and the first monitor point MP1 on the work-implement operation plane (X-Z plane), and stores, in the storage section 41, the position [Xlp3*c*, Zlp3*c*] of the third-link-pin central point LP3, and the position [Xmp1*c*, Zmp1*c*] of the first monitor point MP1.

At Step S46, on the basis of the position of the mark 86 stored at Step S42, and the positions of the third-link-pin central point LP3 and the first monitor point MP1 stored at Step S45 in the setting process for the third monitor point MP3, the position of the third monitor point MP3 inside the work device 8 is calculated.

The vector originating at the third-link-pin central point LP3 and terminating at the first monitor point MP1 is defined as w1, the vector originating at the third-link-pin central point LP3 and terminating at the third monitor point MP3 is defined as w3, and the monitor-point-setting calculating section 40*e* calculates the position of the third monitor point MP3 inside the work device 8 as a length Lmp3 of the vector w3, and an angle θmp3 formed between the vectors w1 and w3.

The length Lmp3 of the vector w3 is represented by the following formula.

[Equation 11]

$$Lmp3=|w3|=\sqrt{(Xmp1a^2-Xlp3C^2)+(Zmp1a^2-Zlp3c^2)} \quad (11)$$

In addition, the angle θmp3 formed between the vector w1 and w3 is represented by the following formula using the inner product.

[Equation 12]

$$\theta mp3 = \cos^{-1}\left(\frac{w1\cdot w3}{|w1||w3|}\right)=\cos^{-1}\left(\frac{\begin{matrix}(Xmp1c-Xlp3c)(Xmp1a-Xlp3c)+\\(Zmp1c-Zlp3c)(Zmp1c-Zlp3c)\end{matrix}}{Lmp1\cdot Lmp3}\right) \quad (12)$$

At Step S47, a signal indicating that setting of the monitor point has been completed is input after the setting of the third monitor point MP3 has been completed, and the setting process ends.

In this manner, in the present embodiment, the work-device-position calculating section 40*c* calculates the coordinate values of the fixed mark 86 in a state where the position of the first monitor point MP1 for which dimensional information is set is aligned with the position of the fixed mark 86. In addition, the display controller 31 further has the monitor-point-setting calculating section 40*e* that calculates the angle formed between the first vector w1 originating at the first coupling point LP3 and terminating at the first monitor point MP1 and each of the second vectors w2 and w3 originating at the first coupling point LP3 and terminating at the fixed mark 86, and the lengths of the second vectors w2 and w3 in a state where the position of the unset monitor point MP2 or MP3 which are on the work device 8 and for which dimensional information is not set is aligned with the position of the fixed mark 86, and sets the angles and the lengths of the second vectors w2 and w3 as the dimensional information on the unset monitor points MP2 and MP3.

According to the thus-configured hydraulic excavator 1 according to the present embodiment, it is possible to: calculate the coordinate values of the fixed mark 86 in a state where the position of the first monitor point MP1 for which dimensional information is set is aligned with the position of the fixed mark 86; and calculate the angle formed between the vector w1 (first vector) originating at the third-link-pin central point (first coupling point) LP3 and terminating at the first monitor point MP1 and each of the vectors w2 and w3 (second vector) originating at the third-link-pin central point LP3 and terminating at the fixed mark 86, and the lengths of the vectors w2 and w3 in a state where the position of the second or third monitor point MP2 or MP3 (unset monitor point) for which dimensional information is not set is aligned with the position of the fixed mark 86, and it is possible thereby to set the dimensional information on the second and third monitor points MP2 and MP3.

Note that in the present embodiment, the work-device-position calculating section 40*c* calculates positions on the work-implement operation plane (X-Z plane), and a warning that nothing other than the work implement 3 should be moved until the setting-calculation process for monitor points ends is displayed on the display section 38, in order for the positional relationship between the mark 86 and the center of the first link pin 20, which is the origin, to remain unchanged; however, in a case of the hydraulic excavator 1 including the correction information receiving section 36 and the antennas 23*a* and 23*b*, it is possible to know also a movement of the position of the center of the first link pin 20, which is the origin, by the monitor-point-setting calculating section 40*e* using positions in the global coordinate system calculated by the work-device-position calculating section 40*c*, and so the setting-calculation process for monitor points can be performed even if operation of a structure other than the work implement 3 is performed.

Although embodiments of the present invention are mentioned in detail thus far, the present invention is not limited to the embodiments explained above, but includes various variants. For example, although rotation angles of the boom 6, the arm 7 and the work device 8 are sensed by IMUs in the embodiments explained above, for example, linear encoders to measure cylinder-stroke lengths may be mounted on the first to third cylinders 9 to 11, and rotation angles of the boom 6, the arm 7 and the work device 8 may be obtained by link computation using the lengths of extension or retraction of the cylinders and machine-body dimensional parameters stored in the storage section 41.

In addition, the embodiments explained above are explained in detail in order to explain the present invention in an easy-to-understand manner, and the present invention is not necessarily limited to embodiments including all the explained configurations. Furthermore, it is also possible to add configurations of an embodiment to configurations of another embodiment, and it is also possible to delete some of configurations of an embodiment or to replace some of configurations of an embodiment with some of configurations of another embodiment.

DESCRIPTION OF REFERENCE CHARACTERS

1: Hydraulic excavator (construction machine)
2: Vehicle main body
3: Work implement
4: Upper swing structure
5: Lower track structure
6: Boom
7: Arm
8: Work device
8*a*: Hydraulic breaker
8*b*: Bucket
8*c*: Secondary crusher
8*d*: Primary crusher
9: First cylinder
10: Second cylinder
11: Third cylinder
12: Cab
13: Swing motor
14: Hydraulic controller
15*a*: Crawler

15*b*: Crawler
15*c*: Display control section
16*a*: Travel motor
16*b*: Travel motor
17: Slewing ring
18: Machine-body operation device
19: Display device
20: First link pin
21: Second link pin
22: Third link pin (first coupling pin)
23: Antenna
23*a*, 23*b*: Antenna
24: Machine-body control system
25: Display system
26: Machine-body controller
27: Operation member
28: Operation-amount sensing section
29: Input/output section
30: Calculating section
31: Display controller
32: Machine-body inclination-angle sensor
33: First rotation-angle sensor
34: Second rotation-angle sensor
35: Third rotation-angle sensor
36: Correction information receiving section
37: Operation section
38: Display section
39: Input/output section
40: Calculating section
40*a*: Global-position calculating section
40*b*: Posture calculating section
40*c*: Work-device-position calculating section
40*d*: Drawing calculating section
41: Storage section
42: First cylinder pin
43: Second cylinder pin
44: Third cylinder pin (second coupling pin)
48: Target-surface FIG.
49: First drawing FIG.
49*a*: First post-deformation drawing FIG.
53: First drawing FIG.
53*a*: First post-deformation drawing FIG.
54: Second drawing FIG.
54*a*: Second post-deformation drawing FIG.
55: Third drawing FIG.
55*a*: Third post-deformation drawing FIG.
56: Bottom surface
57: Work-device frame (base portion)
58: Work-device arm
59: Fourth link pin (third coupling pin)
63: Fourth cylinder
64: Fourth rotation-angle sensor (first posture sensor)
65: First drawing FIG.
65*a*: First post-deformation drawing FIG.
66: Second drawing FIG.
66*a*: Second post-deformation drawing FIG.
67: Work-device frame (base portion)
68: First work-device arm (first driven portion)
69: Second work-device arm (second driven portion)
75: Fourth link pin (third coupling pin)
76: Fourth cylinder
77: Fifth link pin (fourth coupling pin)
78: Fifth cylinder
79: Fourth rotation-angle sensor (first posture sensor)
80: Fifth rotation-angle sensor (second posture sensor)
81: First drawing FIG.
81*a*: First post-deformation drawing FIG.
82: Second drawing FIG.
82*a*: Second post-deformation drawing FIG.
83: Third drawing FIG.
83*a*: Third post-deformation drawing FIG.
86: Mark
90: External storage device
CP3: Third-cylinder-pin central point (second coupling point)
FP1: First feature point
FP2: Second feature point
LP3: Third-link-pin central point (first coupling point)
MP1: First monitor point
MP2: Second monitor point (unset monitor point)
MP3: Third monitor point (unset monitor point)
OP1: Offset
w1: First vector
w2, w3: Second vector

The invention claimed is:

1. A construction machine comprising:

a work implement having a work device attached thereto pivotably via a first coupling pin and a second coupling pin;

a display controller that creates a drawing figure representing a side surface of the work device on a basis of drawing information and dimensional information on the work device, and creates a target-surface figure representing a target surface on a basis of target-surface information; and a display device that displays the drawing figure and the target-surface figure, wherein the dimensional information on the work device includes positional information on a first coupling point positioned on a central axis of the first coupling pin, a second coupling point positioned on a central axis of the second coupling pin, and a first monitor point positioned on a contour of the work device, the contour being projected onto an operation plane of the work implement, the drawing information on the work device includes image information on a first drawing figure representing at least part of the work device, the part including the first coupling point, the second coupling point and the first monitor point, the display controller is configured to calculate a posture of the work implement, calculate a coordinate value of each of the first coupling point, the second coupling point and the first monitor point in a coordinate system on an image on the display device on the basis of the postural information on the work implement and the dimensional information on the work device, deform the first drawing figure to create a first post-deformation drawing figure such that a triangle having vertexes at the first coupling point, the second coupling point and the first monitor point in the first drawing figure becomes congruent with a triangle having vertexes at the first coupling point, the second coupling point and the first monitor point in the coordinate system on the image on the display device, and arrange the first post-deformation drawing figure on a screen of the display device such that positions of the first coupling point, the second coupling point and the first monitor point in the first post-deformation drawing figure are arranged correspondingly to positions of the first coupling point, the second coupling point and the first monitor point, respectively, in the coordinate system on the image on the display device.

2. The construction machine according to claim 1, wherein the work device is a bucket, the first monitor point is positioned at a tip of the bucket, the dimensional information on the work device further includes positional information on the first monitor point, a second monitor point at a position on a rear surface of the bucket, and a first feature point at another position on the rear surface of the bucket, the drawing information on the work device further includes image information on a second drawing figure representing part of the work device, the part including the first monitor point, the second monitor point and the first feature point, and the display controller is configured to calculate a coordinate value of each of the second monitor point and the first feature point on the basis of the dimensional information on the work device, deform the second drawing figure to create a second post-deformation drawing figure such that a triangle having vertexes at the first monitor point, the second monitor point and the first feature point in the second drawing figure becomes congruent with a triangle having vertexes at the first monitor point, the second monitor point and the first feature point in the coordinate system on the image on the display device, and arrange the second post-deformation drawing figure on the screen of the display device such that positions of the first monitor point, the second monitor point and the first feature point in the second drawing figure are arranged correspondingly to positions of the first monitor point, the second monitor point and the first feature point, respectively, in the coordinate system on the image on the display device.

3. The construction machine according to claim 2, wherein the dimensional information on the work device further includes positional information on the second monitor point, the first feature point and a third monitor point at a position on the rear surface of the bucket, the drawing information on the work device further includes image information on a third drawing figure representing part of the work device, the part including the second monitor point, the third monitor point and the first feature point, and the display controller is configured to calculate a coordinate value of the third monitor point on the basis of the dimensional information on the work device, deform the third drawing figure to create a third post-deformation drawing figure such that a triangle having vertexes at the second monitor point, the third monitor point and the first feature point in the third drawing figure becomes congruent with a triangle having vertexes at the second monitor point, the third monitor point and the first feature point in the coordinate system on the image on the display device, and arrange the third post-deformation drawing figure on the screen of the display device such that positions of the second monitor point, the third monitor point and the first feature point in the third post-deformation drawing figure are arranged correspondingly to positions of the second monitor point, the third monitor point and the first feature point, respectively, in the coordinate system on the image on the display device.

4. The construction machine according to claim 1, wherein the work device has a base portion including the first coupling point, the second coupling point and the first monitor point, and a first driven portion attached pivotably to the base portion via a third coupling pin, a first posture sensor that senses a posture of the first driven portion is further provided, the dimensional information on the work device further includes positional information on a first feature point positioned on a central axis of the third coupling pin, and a second monitor point positioned at a tip of the first driven portion, the drawing information on the work device further includes image information on a second drawing figure representing the first driven portion including the first feature point and the second monitor point, and the display controller is configured to calculate a coordinate value of each of the first feature point and the second monitor point on a basis of the dimensional information on the work device and the posture of the first driven portion, the posture being sensed by the first posture sensor, deform the second drawing figure to create a second post-deformation drawing figure such that a length of a line segment linking the first feature point and the second monitor point in the second drawing figure matches a length of a line segment linking the first feature point and the second monitor point in the coordinate system on the image on the display device, and arrange the second post-deformation drawing figure on the screen of the display device such that positions of the first feature point and the second monitor point in the second post-deformation drawing figure are arranged correspondingly to positions of the first feature point and the second monitor point, respectively, in the coordinate system on the image.

5. The construction machine according to claim 4, wherein the work device further has a second driven portion attached pivotably to the base portion via a fourth coupling pin, a second posture sensor that senses a posture of the second driven portion is further provided, the dimensional information on the work device further includes positional information on a second feature point positioned on a central axis of the fourth coupling pin, and a third monitor point positioned at a tip of the second driven portion, the drawing information on the work device further includes image information on a third drawing figure representing the second driven portion including the second feature point and the third monitor point, and the display controller is configured to calculate a coordinate value of each of the first feature point and the third monitor point on a basis of the dimensional information on the work device and the posture of the second driven portion, the posture being sensed by the second posture sensor, deform the third drawing figure to create a third post-deformation drawing figure such that a length of a line segment linking the second feature point and the third monitor point in the drawing figure matches a length of a line segment linking the second feature point and the third monitor point in the coordinate system on the image on the display device, and arrange the third post-deformation drawing figure on the screen of the display device such that positions of the second feature point and the third monitor point in the third post-deformation drawing figure are arranged correspondingly to positions of the second feature point and the third monitor point, respectively, in the coordinate system on the image.

6. The construction machine according to claim 1, wherein the display controller is configured to calculate a coordinate value of a fixed mark in a state where the position of the first monitor point for which dimensional information is set is aligned with a position of the fixed mark, and calculate an angle formed between a first vector originating at the first coupling point and terminating at the first monitor point and a second vector originating at the first coupling point and terminating at the fixed mark, and a length of the second vector in a state in which a position of an unset monitor point for which dimensional information on the work device is not set is aligned with the position of the fixed mark, and sets the angle and the length of the second vector as the dimensional information on the unset monitor point.

7. The construction machine according to claim 1, wherein the display controller can be connected with an external storage device, and can store therein the drawing information and the dimensional information on the work device, the information being stored in the external storage device.

* * * * *